US010493309B2

(12) United States Patent
Jue et al.

(10) Patent No.: US 10,493,309 B2
(45) Date of Patent: Dec. 3, 2019

(54) CANTILEVERED UNWEIGHTING SYSTEMS

(71) Applicant: ALTERG, INC., Fremont, CA (US)

(72) Inventors: Clifford T. Jue, Santa Cruz, CA (US); Amir Belson, Los Altos, CA (US); Eric R. Kuehne, Los Gatos, CA (US)

(73) Assignee: AlterG, Inc., Fremont, CA (US)

( * ) Notice: Subject to any disclaimer, the term of this patent is extended or adjusted under 35 U.S.C. 154(b) by 0 days.

(21) Appl. No.: 14/769,118

(22) PCT Filed: Mar. 14, 2014

(86) PCT No.: PCT/US2014/028694

§ 371 (c)(1),
(2) Date: Aug. 20, 2015

(87) PCT Pub. No.: WO2014/153016

PCT Pub. Date: Sep. 25, 2014

(65) Prior Publication Data

US 2016/0001119 A1 Jan. 7, 2016

Related U.S. Application Data

(60) Provisional application No. 61/784,510, filed on Mar. 14, 2013.

(51) Int. Cl.
*A63B 21/00* (2006.01)
*A63B 69/00* (2006.01)
(Continued)

(52) U.S. Cl.
CPC .. *A63B 21/00181* (2013.01); *A63B 21/00069* (2013.01); *A63B 21/4009* (2015.10);
(Continued)

(58) Field of Classification Search
CPC ..... A63B 21/00069; A63B 21/00181; A63B 21/4009; A63B 69/0064;
(Continued)

(56) References Cited

U.S. PATENT DOCUMENTS 32,109 A 4/1861 DeBrame
43,972 A 8/1864 Coldwell
(Continued)

FOREIGN PATENT DOCUMENTS

CA 2216216 A 5/1999
CN 202860021 U 4/2013
(Continued)

OTHER PUBLICATIONS

Kuehne et al.; U.S. Appl. No. 15/588,549 entitled "Differential air pressure systems," filed May 5, 2017.
(Continued)

*Primary Examiner* — Gary D Urbiel Goldner
(74) *Attorney, Agent, or Firm* — Shay Glenn LLP

(57) ABSTRACT

An unweighting system includes a frame having a pair of upright bars, and a cantilevered arm assembly, and a pair of resilient members. The frame is configured to connect to or at least partially encircle an exercise device. The cantilevered arm assembly includes a pair of cantilevers. Each cantilever is attached to one of the upright bars, and the pair of cantilevers is configured to receive and couple to the user to unload a portion of the user's weight as the user exercises on the exercise device while coupled to the pair of cantilevers.

12 Claims, 22 Drawing Sheets

(51) Int. Cl.

| | |
|---|---|
| ***A63B 22/02*** | (2006.01) |
| ***A63B 23/04*** | (2006.01) |
| ***A63B 21/005*** | (2006.01) |
| ***A63B 21/008*** | (2006.01) |
| ***A63B 21/02*** | (2006.01) |
| ***A63B 21/055*** | (2006.01) |
| ***A63B 21/068*** | (2006.01) |
| ***A63B 22/00*** | (2006.01) |
| ***A63B 22/06*** | (2006.01) |
| ***A63B 21/04*** | (2006.01) |
| ***A63B 71/00*** | (2006.01) |
| ***A63B 21/062*** | (2006.01) |

(52) U.S. Cl.

CPC ..... *A63B 22/02* (2013.01); *A63B 23/04* (2013.01); *A63B 69/0064* (2013.01); *A63B 21/008* (2013.01); *A63B 21/0058* (2013.01); *A63B 21/0085* (2013.01); *A63B 21/023* (2013.01); *A63B 21/025* (2013.01); *A63B 21/0428* (2013.01); *A63B 21/055* (2013.01); *A63B 21/068* (2013.01); *A63B 21/0628* (2015.10); *A63B 22/0056* (2013.01); *A63B 22/0605* (2013.01); *A63B 22/0664* (2013.01); *A63B 2071/0063* (2013.01); *A63B 2220/51* (2013.01); *A63B 2220/805* (2013.01)

(58) Field of Classification Search

CPC ... A63B 22/02–0292; A63B 1/00; A63B 3/00; A63B 7/00; A63B 21/00047; A63B 21/00058; A63B 21/00072; A63B 21/00185; A63B 21/005; A63B 21/0058; A63B 21/008; A63B 21/0083; A63B 21/0085; A63B 21/0087; A63B 21/02; A63B 21/023; A63B 21/025; A63B 21/04; A63B 21/0407; A63B 21/0414; A63B 21/0421; A63B 21/0428; A63B 21/0435; A63B 21/0442; A63B 21/045; A63B 21/0455; A63B 21/055; A63B 21/0552; A63B 21/0555; A63B 21/0557; A63B 21/0615; A63B 21/0616; A63B 21/062; A63B 21/0622; A63B 21/0624; A63B 21/0626; A63B 21/065; A63B 21/068; A63B 21/15; A63B 21/158; A63B 21/159; A63B 21/4027; A63B 21/4047; A63B 21/4049; A63B 22/0046; A63B 22/0048; A63B 22/0056; A63B 22/04; A63B 22/06; A63B 22/0605; A63B 22/0664; A63B 23/04; A63B 26/00; A63B 26/003; A63B 69/0057; A63B 69/0059; A63B 71/0054; A63B 2071/0063; A63B 2071/0072; A63B 2208/0285; A63B 2208/029; A63B 2225/09; A63B 2225/093; A63B 21/00076; A61H 1/0218; A61H 1/0229; A61H 1/0262; A61H 3/00; A61H 3/008

See application file for complete search history.

(56) References Cited

U.S. PATENT DOCUMENTS

| | | | | |
|---|---|---|---|---|
| 68,637 | A | | 9/1867 | Mason |
| 76,053 | A | | 3/1868 | Colwell |
| 217,918 | A | | 7/1879 | White |
| 219,439 | A | | 9/1879 | Blend |
| 458,136 | A | | 8/1891 | Wilder |
| 823,812 | A | | 6/1906 | Ritter |
| 1,193,374 | A | | 8/1916 | Gilliam |
| 1,223,707 | A | | 4/1917 | Lyon |
| 1,507,554 | A | | 9/1924 | Cooper |
| 1,553,520 | A | | 9/1925 | Dougherty |
| 1,578,852 | A | | 3/1926 | Schmutzer |
| 1,580,508 | A | | 4/1926 | Liles |
| 1,586,254 | A | | 5/1926 | Lovejoy |
| 2,050,500 | A | | 8/1936 | Osborn |
| 2,108,566 | A | | 2/1938 | Brooke |
| 2,109,188 | A | | 2/1938 | Elizaveta |
| 2,327,671 | A | | 8/1943 | Rupprecht |
| 2,438,979 | A | | 4/1948 | Lea |
| 2,719,568 | A | | 10/1955 | Webb |
| 2,785,004 | A | | 3/1957 | Cooper |
| 2,819,755 | A | | 1/1958 | Harold et al. |
| 2,871,915 | A | | 2/1959 | Hogan |
| 2,892,455 | A | | 6/1959 | Hutton |
| 2,991,523 | A | | 7/1961 | Del Conte |
| 3,085,357 | A | | 4/1963 | Nissen et al. |
| 3,140,869 | A | | 7/1964 | Pacuk |
| 3,165,314 | A | | 1/1965 | Clearman et al. |
| 3,176,793 | A | | 4/1965 | Roland |
| 3,252,704 | A | | 5/1966 | Louise |
| 3,730,587 | A | | 5/1973 | Bloxham et al. |
| 3,738,027 | A | | 6/1973 | Schoch |
| 3,747,596 | A | | 7/1973 | Mills |
| 3,778,052 | A | | 12/1973 | Andow et al. |
| 3,824,994 | A | | 7/1974 | Soderberg, Sr. |
| 4,188,966 | A | * | 2/1980 | Palmer ..... A61H 3/04 135/67 |
| 4,205,839 | A | | 6/1980 | Best |
| 4,211,426 | A | | 7/1980 | Motloch |
| 4,479,646 | A | | 10/1984 | Beistegui Chirapozu |
| 4,551,108 | A | | 11/1985 | Bass |
| 4,655,447 | A | | 4/1987 | Dubrinsky et al. |
| 4,731,882 | A | | 3/1988 | Ekman |
| 4,805,601 | A | | 2/1989 | Eischen, Sr. |
| 4,861,021 | A | | 8/1989 | Edwards et al. |
| 4,863,163 | A | | 9/1989 | Wehrell |
| 4,911,426 | A | | 3/1990 | Scales |
| 4,921,245 | A | | 5/1990 | Roberts |
| 4,922,426 | A | | 5/1990 | Obara et al. |
| 4,941,497 | A | | 7/1990 | Prather et al. |
| 4,961,544 | A | | 10/1990 | Bidoia |
| 4,961,573 | A | | 10/1990 | Wehrell |
| 4,968,028 | A | | 11/1990 | Wehrell |
| 4,976,623 | A | | 12/1990 | Owsley |
| 5,000,440 | A | | 3/1991 | Lynch |
| 5,029,579 | A | | 7/1991 | Trammel |
| 5,048,836 | A | | 9/1991 | Bellagamba |
| 5,064,193 | A | | 11/1991 | Sainte et al. |
| 5,070,816 | A | | 12/1991 | Wehrell |
| 5,133,339 | A | | 7/1992 | Whalen et al. |
| 5,156,549 | A | | 10/1992 | Wehrell |
| 5,174,590 | A | | 12/1992 | Kerley et al. |
| 5,176,597 | A | | 1/1993 | Bryne |
| 5,221,241 | A | | 6/1993 | Bare |
| 5,273,502 | A | * | 12/1993 | Kelsey ..... A61H 1/0229 482/66 |
| 5,275,426 | A | | 1/1994 | Tankersley |
| 5,288,283 | A | | 2/1994 | Meeker |
| 5,348,035 | A | | 9/1994 | Porter |
| 5,360,384 | A | | 11/1994 | Toensing |
| 5,362,298 | A | | 11/1994 | Brown et al. |
| 5,368,533 | A | * | 11/1994 | Feuer ..... A63B 21/154 482/134 |
| 5,372,561 | A | | 12/1994 | Lynch |
| 5,391,115 | A | | 2/1995 | Bessey |
| 5,398,678 | A | | 3/1995 | Gamow |
| 5,403,253 | A | | 4/1995 | Gaylord |
| 5,403,270 | A | | 4/1995 | Schipper |
| 5,435,798 | A | | 7/1995 | Habing et al. |
| 5,512,029 | A | | 4/1996 | Barnard et al. |
| 5,526,893 | A | | 6/1996 | Higer |
| 5,569,129 | A | | 10/1996 | Seif Naraghi et al. |
| 5,577,984 | A | | 11/1996 | Bare, II |
| 5,593,368 | A | | 1/1997 | Checketts |
| 5,601,527 | A | | 2/1997 | Selkowitz |
| 5,603,677 | A | | 2/1997 | Sollo |
| 5,626,540 | A | | 5/1997 | Hall |

(56) References Cited

U.S. PATENT DOCUMENTS 5,662,560 A * 9/1997 Svendsen ..... A61H 3/04 482/54
5,667,461 A 9/1997 Hall
5,671,822 A 9/1997 Phillips
5,695,432 A 12/1997 Soderlund
5,704,880 A 1/1998 Amatulle
5,704,881 A 1/1998 Dudley
5,706,822 A 1/1998 Khavari
5,738,616 A 4/1998 Robertson
5,788,606 A * 8/1998 Rich ..... A63B 69/0064 482/27
5,816,983 A 10/1998 Dawes et al.
5,857,944 A 1/1999 Cone et al.
5,876,311 A 3/1999 Coates et al.
5,893,367 A 4/1999 Dubats et al.
5,919,119 A 7/1999 Bohmer et al.
5,919,419 A 7/1999 Majuri
5,921,892 A 7/1999 Easton
5,960,480 A 10/1999 Neustater et al.
6,093,024 A 7/2000 Sokolowski
6,120,418 A 9/2000 Plough
6,128,782 A 10/2000 Young et al.
6,146,315 A 11/2000 Schonenberger
6,158,389 A 12/2000 Wehrell
6,217,493 B1 4/2001 Spletzer
6,223,854 B1 5/2001 Nolz
6,244,379 B1 6/2001 Larson
6,261,205 B1 7/2001 Elefson
6,270,414 B2 8/2001 Roelofs
6,273,844 B1 8/2001 Kelsey et al.
6,280,361 B1 8/2001 Harvey et al.
6,405,685 B1 6/2002 Cox
6,436,009 B1 8/2002 Marucci
6,438,756 B1 8/2002 Colorado
6,482,128 B1 11/2002 Michalow
6,490,733 B1 12/2002 Casaubon
6,494,811 B1 12/2002 Alessandri
6,527,285 B1 3/2003 Calandro, II
6,554,747 B1 4/2003 Rempe
6,578,594 B1 6/2003 Bowen et al.
6,612,845 B1 9/2003 Macri et al.
6,645,126 B1 11/2003 Martin et al.
6,648,411 B2 11/2003 Julien
6,656,091 B1 12/2003 Abelbeck et al.
6,666,801 B1 12/2003 Michalow
6,669,605 B2 12/2003 Scates
6,679,510 B2 1/2004 Perena
6,689,075 B2 2/2004 West
6,742,523 B2 6/2004 Dubats
6,783,482 B2 8/2004 Oglesby et al.
6,821,233 B1 11/2004 Colombo et al.
6,892,403 B2 5/2005 Liljedahl
6,918,858 B2 7/2005 Watterson et al.
6,932,709 B1 8/2005 Gubitosi et al.
6,935,353 B2 8/2005 Hawkes et al.
6,966,870 B2 11/2005 Lan
6,978,497 B1 * 12/2005 Takizawa ..... A61G 7/1019 5/86.1
6,988,951 B1 1/2006 Newman et al.
7,166,064 B2 1/2007 Watterson et al.
7,240,621 B2 7/2007 Chepurny et al.
7,278,958 B2 10/2007 Morgan
7,294,094 B1 11/2007 Howle
7,335,141 B2 2/2008 Piane
7,341,543 B2 3/2008 Dandy
7,381,163 B2 6/2008 Gordon et al.
7,472,964 B2 1/2009 King
7,494,453 B2 2/2009 Wehrell
7,544,172 B2 6/2009 Santos-Munne et al.
7,572,190 B2 8/2009 Habing
7,572,209 B2 8/2009 Brennan
7,591,795 B2 9/2009 Whalen et al.
7,594,281 B1 9/2009 Stinson et al.
7,608,025 B1 10/2009 Best
7,614,991 B2 11/2009 Fox
7,625,320 B2 12/2009 Wehrell
7,651,450 B2 1/2010 Wehrell
7,666,126 B2 2/2010 Rempe
7,727,076 B2 6/2010 Bapst et al.
7,780,587 B2 8/2010 Thornton et al.
7,785,242 B2 8/2010 Solomon
7,837,597 B2 11/2010 Reyes et al.
7,850,629 B2 12/2010 Ravikumar
7,857,731 B2 12/2010 Hickman et al.
7,862,478 B2 1/2011 Watterson et al.
7,874,223 B2 1/2011 Sugar et al.
7,883,450 B2 2/2011 Hidler
7,887,471 B2 2/2011 McSorley
7,914,420 B2 3/2011 Daly et al.
7,938,756 B2 5/2011 Rodetsky et al.
7,955,219 B2 6/2011 Birrell et al.
7,998,040 B2 8/2011 Kram et al.
8,083,643 B2 12/2011 Ng et al.
8,109,478 B2 2/2012 Tristao
8,152,699 B1 4/2012 Ma et al.
8,172,724 B2 5/2012 Solomon
8,221,293 B2 7/2012 Hoffman et al.
8,235,724 B2 8/2012 Gilley et al.
8,246,354 B2 8/2012 Chu et al.
8,251,863 B2 8/2012 Faulring et al.
8,425,620 B2 4/2013 Johnson et al.
8,447,401 B2 5/2013 Miesel et al.
8,464,716 B2 6/2013 Kuehne et al.
8,470,051 B2 6/2013 Moyer et al.
8,480,602 B1 * 7/2013 Cook ..... A63B 69/0064 482/54
8,656,516 B1 2/2014 Reinhardt Rawlings et al.
8,762,167 B2 6/2014 Blander et al.
8,840,572 B2 9/2014 Whalen et al.
8,888,664 B1 11/2014 Butler
8,968,163 B1 * 3/2015 Vidmar ..... A61H 3/008 482/43
9,087,454 B2 7/2015 Crivello et al.
9,314,393 B2 4/2016 Kim et al.
9,370,680 B1 6/2016 Macaulay et al.
9,474,934 B1 10/2016 Krueger et al.
9,483,957 B1 11/2016 Fuemmeler
9,672,754 B2 6/2017 Yuen et al.
9,713,439 B1 7/2017 Wu et al.
2002/0010056 A1 1/2002 Borsheim
2002/0022554 A1 * 2/2002 Borsheim ..... A63B 22/02 482/54
2002/0032103 A1 3/2002 Cook
2002/0065173 A1 * 5/2002 Cook ..... A63B 69/0064 482/69
2004/0016043 A1 1/2004 Uno et al.
2004/0212240 A1 10/2004 Zwezdaryk
2004/0245298 A1 12/2004 Refsum
2004/0249675 A1 12/2004 Stark et al.
2005/0026757 A1 2/2005 Creary
2005/0101448 A1 * 5/2005 He ..... A61H 1/0237 482/54
2005/0183759 A1 8/2005 Wolfe
2005/0250624 A1 11/2005 Yu
2005/0288157 A1 * 12/2005 Santos-Munne ..... A61H 3/008 482/66
2006/0031984 A1 * 2/2006 Takizawa ..... A61H 1/0266 5/86.1
2006/0052728 A1 3/2006 Kerrigan et al.
2006/0062413 A1 3/2006 Wehrell
2006/0079378 A1 4/2006 Ader
2007/0016116 A1 * 1/2007 Reinkensmeyer ..... A63B 69/0064 601/5
2007/0219059 A1 9/2007 Schwartz et al.
2007/0219069 A1 9/2007 Nativ
2007/0272484 A1 11/2007 Helms
2008/0017227 A1 1/2008 Ward
2008/0070757 A1 3/2008 Albert
2008/0229495 A1 * 9/2008 Takizawa ..... A61G 7/1019 5/86.1
2008/0281633 A1 11/2008 Burdea et al.
2008/0282442 A1 11/2008 Bauvois

(56) References Cited

U.S. PATENT DOCUMENTS

| | | | | |
|---|---|---|---|---|
| 2008/0300118 | A1 | 12/2008 | Wehrell | |
| 2008/0306412 | A1 | 12/2008 | Nieminen et al. | |
| 2009/0014004 | A1 | 1/2009 | Whalen et al. | |
| 2009/0047644 | A1 | 2/2009 | Mensah et al. | |
| 2009/0082700 | A1 | 3/2009 | Whalen et al. | |
| 2009/0221404 | A1 | 9/2009 | Dorogusker et al. | |
| 2009/0236176 | A1 | 9/2009 | Sheu et al. | |
| 2009/0255531 | A1 | 10/2009 | Johnson et al. | |
| 2009/0269728 | A1 | 10/2009 | Verstegen et al. | |
| 2010/0000547 | A1 | 1/2010 | Johnson et al. | |
| 2010/0006737 | A1 | 1/2010 | Colombo et al. | |
| 2010/0139057 | A1 | 6/2010 | Soderberg et al. | |
| 2010/0170546 | A1 | 7/2010 | Popovic et al. | |
| 2010/0197462 | A1 | 8/2010 | Piane | |
| 2010/0197465 | A1 | 8/2010 | Stevenson | |
| 2010/0248903 | A1 | 9/2010 | Cardile | |
| 2010/0279837 | A1 | 11/2010 | Stengel | |
| 2011/0086743 | A1* | 4/2011 | Stewart | A63B 22/001 482/52 |
| 2011/0098157 | A1 | 4/2011 | Whalen et al. | |
| 2011/0098615 | A1 | 4/2011 | Whalen et al. | |
| 2011/0179068 | A1 | 7/2011 | O'Brien | |
| 2011/0219899 | A1 | 9/2011 | Dize et al. | |
| 2012/0004581 | A1 | 1/2012 | Dinon | |
| 2012/0029666 | A1 | 2/2012 | Crowley et al. | |
| 2012/0042917 | A1 | 2/2012 | Workman et al. | |
| 2012/0238921 | A1 | 9/2012 | Kuehne et al. | |
| 2012/0277643 | A1 | 11/2012 | Whalen et al. | |
| 2012/0302301 | A1 | 11/2012 | Homsi | |
| 2013/0095459 | A1 | 4/2013 | Tran | |
| 2013/0117908 | A1 | 5/2013 | Dyson | |
| 2013/0324893 | A1 | 12/2013 | Kuehne et al. | |
| 2013/0325491 | A1 | 12/2013 | Ferrari | |
| 2014/0026893 | A1 | 1/2014 | Johnson et al. | |
| 2014/0058312 | A1 | 2/2014 | Ziehler et al. | |
| 2014/0081661 | A1 | 3/2014 | Fu et al. | |
| 2014/0113775 | A1 | 4/2014 | Egan | |
| 2014/0147820 | A1 | 5/2014 | Snow et al. | |
| 2014/0228985 | A1 | 8/2014 | Elliott et al. | |
| 2015/0011917 | A1 | 1/2015 | Whalen et al. | |
| 2015/0199494 | A1 | 7/2015 | Koduri et al. | |
| 2015/0251055 | A1 | 9/2015 | Ashby | |
| 2015/0379239 | A1 | 12/2015 | Basta et al. | |
| 2016/0000155 | A1 | 1/2016 | Marecek et al. | |
| 2016/0001118 | A1 | 1/2016 | Kuehne et al. | |
| 2016/0007885 | A1 | 1/2016 | Basta et al. | |
| 2016/0008650 | A1 | 1/2016 | Jue et al. | |
| 2016/0073704 | A1 | 3/2016 | Basta et al. | |
| 2017/0128769 | A1 | 5/2017 | Long et al. | |

FOREIGN PATENT DOCUMENTS

| | | | |
|---|---|---|---|
| DE | 02623091 | A1 | 11/1977 |
| DE | 29508818 | U1 | 11/1995 |
| DE | 19502801 | C2 | 10/1996 |
| DE | 20004959 | U1 | 6/2000 |
| DE | 20313772 | U1 | 12/2003 |
| EP | 0917890 | A2 | 5/1999 |
| EP | 2512758 | A2 | 10/2012 |
| EP | 2532927 | A2 | 12/2012 |
| ES | 2151390 | A1 | 12/2000 |
| FR | 1180387 | A1 | 6/1959 |
| FR | 2755865 | A1 | 5/1998 |
| FR | 2831065 | A1 | 4/2003 |
| FR | 2846888 | A1 | 5/2004 |
| FR | 2939050 | A1 | 6/2010 |
| GB | 2314512 | A | 1/1998 |
| JP | 05-500760 | | 2/1993 |
| JP | 1022334 | | 10/1998 |
| JP | 11-113988 | A | 4/1999 |
| JP | 2001-112886 | | 4/2001 |
| JP | 2002-28202 | A | 1/2002 |
| JP | 2004-073445 | A | 3/2004 |
| JP | 2004329365 | A | 11/2004 |
| JP | 2004353439 | A | 12/2004 |
| JP | 1395000 | | 8/2010 |
| JP | 1421980 | | 8/2011 |
| JP | 2012-214936 | A | 11/2012 |
| KR | 20030086404 | | 11/2003 |
| TW | M339250 | U | 9/2008 |
| WO | WO96/31256 | A1 | 10/1996 |
| WO | WO99/30271 | A1 | 6/1999 |
| WO | WO01/24900 | A1 | 4/2001 |
| WO | WO02/098516 | A1 | 12/2002 |
| WO | WO2004/080365 | A1 | 9/2004 |
| WO | WO2004/103176 | A1 | 12/2004 |
| WO | WO2007/038888 | A1 | 4/2007 |
| WO | WO2007/115565 | A2 | 10/2007 |
| WO | WO2008/030366 | A2 | 3/2008 |
| WO | WO2008/058567 | A1 | 5/2008 |
| WO | WO2009/151630 | A1 | 12/2009 |
| WO | WO2011/089632 | A1 | 7/2011 |
| WO | WO2011/112898 | A1 | 9/2011 |
| WO | WO2012/107700 | A2 | 8/2012 |
| WO | WO2012/118143 | A1 | 9/2012 |
| WO | WO2013/019956 | A1 | 2/2013 |
| WO | WO2013/021709 | A1 | 2/2013 |
| WO | WO2014/138228 | A1 | 9/2014 |
| WO | WO2015/195983 | A1 | 12/2015 |

OTHER PUBLICATIONS

Burgess et al.; Overground walking speed changes when subjected to body weight support conditions for nonimpaired and post stroke individuals; J NeuroEng Rehabil.; 7(6); 10 pgs.; Feb. 2010.

Capó-Lugo et al.; Maximum walking speeds obtained using treadmill and overground robot system in persons with post-stroke hemiplegia; J NeuroEng Rehabil.; 9(80); 14 pgs.; Oct. 2012.

Diaz et al.; Lower-Limb Robotic Rehabilitation: Literature Review and Challenges; Hindawi Pub. Corp.; Journal of Robotics; vol. 2011; Art. ID 759764; 11 pgs.; (accepted for publn.) Sep. 2011.

Hamilton; Low-Tech Alternative to AlterG on Market; Runner's World; 2 pgs.; Aug. 16, 2012; (printed from internet: http://www.runnersworld.com/elite-runners/low-tech-alternative-alterg-market).

Kawai et al.; Rehabilitation apparatus for treadmill walking using lower body positive pressue (Japanese & English abstracts); Aerospace and Environmental Medicine; vol. 44; No. 4; (year of pub. sufficiently earlier than effective US filing date and any foreign priority date) 2007.

Lillegard, R.; Running on air (retrieved Aug. 10, 2016 from the internet: http://www.lightspeedrunningandrehabilitation.com/in-the-news/running-on-air/#more-89); Duluth Superior Magazine; 3 pgs.; Jul. 2, 2012.

Pates, K.; Duluth physical therapist develops running aid; (retrieved Aug. 10, 2016 from the internet: http://www.lightspeedrunningandrehabilitation.com/in-the-news/duluth-physical-therapist-develops-running-aid/#more-92); Duluth News Tribune; 3 pgs.; Jul. 25, 2012.

Patton et al.; KineAssist: Design and development of a robotic overground gait and balance therapy device; Top Stroke Rebabil.; 15(2); pp. 131-139; Mar.-Apr. 2008.

Whalen et al.; Design U.S. Appl. No. 29/337,097 entitled "Adjustable Positive Pressure Support System," filed May 14, 2009.

Whalen et al.; U.S. Appl. No. 15/046,358 entitled "System, method and apparatus for applying air pressure on a portion of the body of an individual," filed Feb. 17, 2016.

Whalen et al.; U.S. Appl. No. 15/143,351 entitled "Systems, methods and apparatus for differential air pressure devices," filed Apr. 29, 2016.

Montion Control Tips; (retrieved from the internet: www.motioncontroltips.com/lead-screws/); 5 pgs; on Dec. 19, 2016.

Kuehne et al.; U.S. Appl. No. 15/916,083 entitled "Monocolumn unweighting systems," filed Mar. 8, 2018.

Whalen et al.; U.S. Appl. No. 15/963,960 entitled "Systems, methods and apparatus for differential air pressure devices," filed Apr. 26, 2018.

(56) References Cited

OTHER PUBLICATIONS

Kuehne et al.; U.S. Appl. No. 15/993,136 entitled "Differential air pressure systems and methods of using and calibrating such systems for mobility impaired users," filed May 30, 2018.
Basta et al.; U.S. Appl. No. 16/010,149 entitled "Unweighting garments for simultaneous use with unweighting andd fall safety systems," filed Jun. 15, 2018.
Basta et al.; U.S. Appl. No. 16/254,503 entitled "Systems and methods for management and scheduling of differential air pressure and other unweighted or assisted treatment systems," filed Jan. 22, 2019.

* cited by examiner

CANTILEVERED UNWEIGHTING SYSTEMS

CROSS REFERENCE TO RELATED APPLICATIONS

This application claims priority to U.S. Provisional Application No. 61/784,510, titled "Cantilevered Unweighting Systems," and filed Mar. 14, 2013, the entirety of which is incorporated by reference herein.

INCORPORATION BY REFERENCE

All publications and patent applications mentioned in this specification are herein incorporated by reference to the same extent as if each individual publication or patent application was specifically and individually indicated to be incorporated by reference.

FIELD

Described herein are various embodiments of unweighting systems for unweighting a user and methods of using such systems. Still further, the embodiments described herein relate to various types of systems used to at least partially support the weight of an individual using a piece of exercise equipment.

BACKGROUND

Methods of counteracting gravitational forces on the human body have been devised for therapeutic applications as well as physical training. Rehabilitation from orthopedic injuries or neurological conditions often benefits from precision unweighting (i.e., partial weight bearing) therapy. One way to counteract the effects of gravity is to suspend a person using a body harness in conjunction with inelastic cords or straps to reduce ground impact forces. However, currently available harness systems are often uncomfortable and require suspension devices or systems that lift the user from above the user's torso.

Many other existing unweighting systems are simple affairs, often relying on stretched bungee cords to provide unweighting forces. However, many of the systems suffer from an inability to easily adjust or control unweighting force. Further, many of the systems rely on inelastic overhead cables that supply minimal vertical compliance.

Differential Air Pressure (DAP) systems have been developed to use air pressure in a sealed chamber enclosing the lower portion of the user's body to simulate a low gravity effect and support a patient without the discomfort of harness systems or the inconvenience of other therapies. While highly controllable and reliable, some DAP systems have an operating envelope and degree of complexity that make them better suited to environments where assistance is readily available.

In view of the above shortcomings and complications in the existing unweighting systems, there remains a need for simple yet effective unweighting systems. In particular, for an average user who may not have a medical condition warranting physical therapy or medical supervision, there is also an additional need for unweighting systems suited to gym or home use. As such, a need exists for an unweighting system that allows users economical and effective alternatives to the current techniques available.

An important characteristic of unweighting systems intended for exercise or gait training is a low vertical spring rate, where the user's vertical position has minimal influence on the unweighting force applied to the user. This is significant because as a user walks or runs, their vertical displacement during different phases of the gait cycle can vary by +/−two inches or more. A low vertical spring rate ensures that the unweighting force is nearly equal during all phases of the gait cycle. While fluid based systems such as DAP or pool-based therapies have inherently low vertical spring rates, the same is not true for most mechanical unweighting systems. The need for a low spring rate often requires the use of very long spring elements such as bungee cords, making these systems less than compact and/or unable to exert more than minimal unweighting forces. A further need is for a compact unweighting system with a low vertical spring rate.

SUMMARY OF THE DISCLOSURE

In general, in one embodiment, an unweighting system includes a frame having a pair of upright bars, a cantilevered arm assembly, and a pair of resilient members. The frame is configured to connect to or at least partially encircle an exercise device. The cantilevered arm assembly includes a pair of cantilevers. Each cantilever is attached to one of the upright bars, and the pair of cantilevers is configured to receive and couple to the user. Each resilient member is coupled with a cantilever of the pair of cantilevers and is configured to unload a portion of the user's weight as the user exercises on the exercise device while coupled to the pair of cantilevers.

In general, in one embodiment, an unweighting system includes a frame having a pair of upright bars and a cantilevered arm assembly. The frame is configured to connect to or at least partially encircle an exercise device. The cantilevered arm assembly includes a pair of cantilevers. Each cantilever attaches to one of the upright bars, and the pair of cantilevers is configured to receive and couple to the user. The cantilevers are configured as resilient members configured to unload a portion of the user's weight as the user exercises on the exercise device while coupled to the pair of cantilevers.

Any of these embodiments can include one or more of the following features. The cantilevered arm assembly can be height adjustable. The cantilevered arm assembly can be attached to the upright bars at one or more fulcrums. The one or more fulcrums can be configured to pivot to provide height adjustment of a distal end of the cantilevered arm assembly. The cantilevered arm assembly can be configured to slide vertically relative to the upright bars, such as to provide height adjustment of the cantilevered arm assembly. The unweighting system can further include a pair of lead screws and nuts. Each lead nut can be coupled with the cantilevers and can be configured to rotate relative to a lead screw to adjust a height of a cantilever. The unweighting system can further include a motor coupled with the lead screw to rotate the lead screw relative to the nut. A user attachment mechanism on each cantilever can be slideable along the cantilever. The resilient members can be single leaf springs. The unweighting system can further include a pair of supports. Each support can be configured to attach to an upright bar and slideably connect to a cantilever. Sliding of the support relative to the cantilever can adjust an amount of unloading provided by the cantilevered arm. The resilient members can be substantially perpendicular to the cantilevered arm assembly. Each support can extend between a cantilever and an upright. Each of the resilient members can be positioned along one of the supports. The resilient members can be attached to the upright bars. The resilient members can be coiled springs. A length of the at least one resilient member can be variable to adjust a degree of unloading experienced by the user. The unweighting system can further include a lead screw and nut connected to the at least one resilient member. The lead screw can be configured to rotate relative to the nut to vary a length of the resilient member. The upright bars and the cantilevers can be configured to form an angle of approximately 90 degrees when the arm assembly is coupled with the user. The cantilevered arm assembly can be configured to receive and couple to the user below the user's torso. The cantilevered arm assembly can be configured to receive and couple proximate to the user's hips. The exercise device can be a treadmill. A distance between the cantilevers at a distal end can be adjustable to fit the user. The cantilevers can be pivotably attached to the uprights. The unweighting system can further include a user support extending between the pair of cantilevers. The user support can have holes therein configured to receive the user's legs. The uprights can be positioned proximate to a front of the treadmill, and each of the resilient members can be coupled to a cantilever through a cable. Each cable can extend over a pulley. The pulley can be attached to an upright proximate to a rear of the treadmill. The unweighting system can further include a connection element extending from one of the cantilevers to the other cantilever.

In general, in one embodiment, an unweighting system includes a frame having an upright bar, a cantilevered arm assembly coupled to the upright bar, and a weight stack coupled to the cantilevered arm assembly. The frame is configured to connect to or at least partially encircle an exercise device. The cantilevered arm assembly is configured to couple to the user. The weight stack is configured to unload a portion of the user's weight as the user exercises on the exercise device while coupled to the cantilevered arm assembly.

Any of these embodiments can include one or more of the following features. The frame can include a second upright bar, and the cantilevered arm assembly can include a pair of cantilevers. Each cantilever can be attached to one of the upright bars. The unweighting system can further include a cable connecting the weight stack to the cantilevered arm assembly. The unweighting system can further include a spring or a dampening unit in the cable. The spring or dampening unit can be configured to provide dampening between upright movement of the user and a weight of the weight stack.

In general, in one embodiment, an unweighting system includes a frame having an upright bar, a cantilevered arm assembly coupled to the upright bar, a ram connected to the cantilevered arm assembly, and a pneumatic or hydraulic pump configured to extend the ram to unload a portion of the user's weight as the user exercises while coupled to the cantilevered arm assembly. The frame is configured to connect to or at least partially encircle an exercise device. The cantilevered arm assembly is configured to couple to the user.

Any of these embodiments can include one or more of the following features. The frame can include a second upright bar, and the cantilevered arm assembly can include a pair of cantilevers. Each cantilever can attach to one of the upright bars. The unweighting system can further include a roller system connected to the ram and the cantilevered arm assembly. The roller system can be configured to allow the cantilevered arm assembly to roll along the upright as the ram is extended.

In general, in one embodiment, an unweighting system includes a frame having a pair of upright bars, a rotatable axle extending between the pair of uprights, a cantilevered arm assembly coupled to the axle and configured to receive and couple to the user, and a torsion spring extending around the axle and connected to the cantilevered arm assembly. The frame is configured to connect to or at least partially encircle an exercise device. The torsion spring is configured to unload a portion of the user's weight as the user exercises on the exercise device while coupled to the pair of cantilevers.

In general, in one embodiment, a method of unweighting a user during exercise includes: (1) coupling a user to a pair of cantilevers of an unweighting system, where the unweighting system includes at least one resilient member; (2) compressing the at least one resilient member to provide a force sufficient to unload a portion of the user's weight; and (3) allowing the user to exercise on an exercise device while the portion of the user's weight is unloaded with the at least one resilient member.

In general, in one embodiment, a system for unweighting an individual during exercise includes a support frame sized for positioning around a piece of exercise equipment wherein a user supported by the support frame may use the piece of exercise equipment. An unweighting assembly is coupled to the support frame and configured to attach to the user. When the user is coupled to the support frame, a portion of the user's weight is borne by the unweighing assembly and support frame.

Any of these embodiments can include one or more of the following features. The system can include a pair of cantilevered arms coupled to a pair of uprights in the support frame. The system can include a pair of arms coupled to a pair of uprights in the support frame so as to unweight the user using a leaf spring action. The system can include a pair of cantilevered arms and a height adjustment assembly attached to each of the support arms. The system can further include a spring loaded unweighing device. The spring loaded unweighting device can be attached between two pieces of a support cable or between the terminal end of a cable and a portion of a support frame. The spring loaded unweighting device can be at least partially contained within an upright of the support frame. The system can further include a height adjustment and compression assembly configured to work in cooperation with a spring support assembly to unweight a user coupled to the support arms. The system can further include a user attachment and width adjustment assembly. The system can further include one or more of a selectively responsive element positioned between the user and the unweighing device. The selectively responsive element can have a response characteristic selected based on at least one of the degree of unweighting or a response frequency based on a user's actions while unweighted by the system. At least one selectively responsive element can be attached in series with a cable used in unweighting a user. At least one selectively responsive element can be attached directly to, adjacent to, or integral with a weight stack used in unweighting the user. At least one selectively responsive element can be attached directly to, adjacent to or integral with an unweighting device used in unweighting the user. The responsiveness of the selectively responsive element can be provided by a spring, a pneumatic cylinder, a hydraulic cylinder, a linear motor, an electromagnet, a shock absorber, or other tuned response element having a response frequency configured for the purposes described above. The responsiveness of the selectively responsive element can be a response selected to correspond to the frequency of movement associated with the activity of the user receiving unweighting, the amount of unweighting, and the mode of unweighting.

Any of these embodiments can further include a velocity dependent dynamic unweighting system. The dynamic unweighting system can include a rotary based mechanism. The rotary based mechanism can include a spring with variable spring resistance and/or a one-way clutch. The dynamic unweighting system can further include a linear based mechanism. The linear based system can include a pneumatic cylinder or a variable flow resistor.

BRIEF DESCRIPTION OF THE DRAWINGS

The novel features of the invention are set forth with particularity in the claims that follow. A better understanding of the features and advantages of the present invention will be obtained by reference to the following detailed description that sets forth illustrative embodiments, in which the principles of the invention are utilized, and the accompanying drawings of which:

DETAILED DESCRIPTION

A variety of unweighting systems are described herein for the purpose of unweighting a user during exercise, particularly during the use of exercise equipment. In general, the unweighting systems described herein are configured to support the weight of a user (such as at least an adult male user) during exercise on an exercise device, such as a treadmill, elliptical climber, stair climber, or stationary bike. The system is configured to attach to or sit around the exercise device without interfering with the use of the exercise equipment.

In general, the unweighting systems described herein include a frame to attach to or extend at least partially around the exercise device and a cantilevered arm assembly, which can include one or more resilient members attached thereto. A variety of different cantilevered beam and leaf spring approaches are described herein individually for ease of understanding. It is to be appreciated that the various components and design features described herein may be combined depending upon the desired responsiveness, loading characteristics or adjustability of a particular system, user characteristics, or operating environment.

Figure 1:
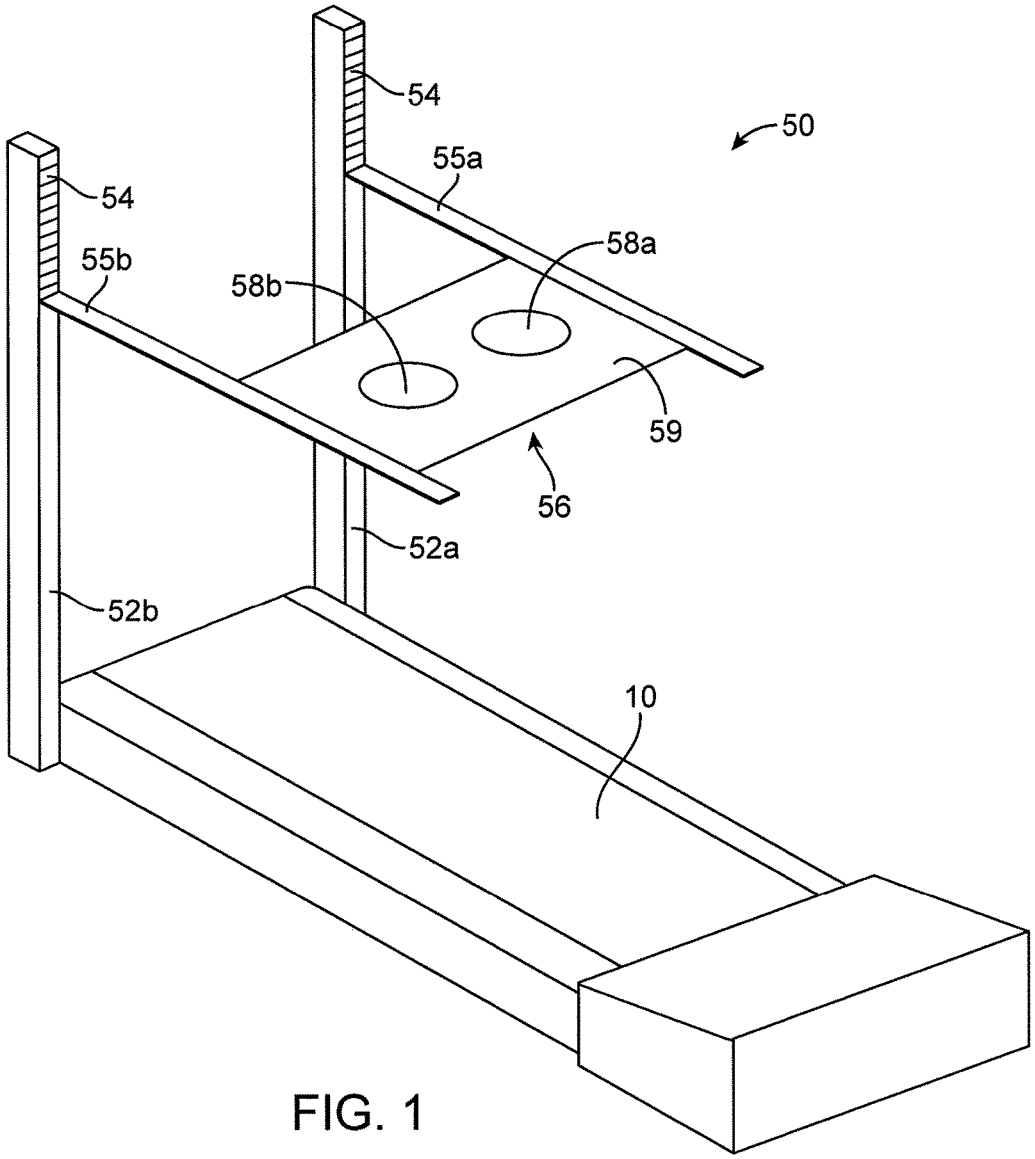
FIG. 1 is a prospective view of a two-armed cantilevered support system.

FIG. 1 is a prospective view of an exemplary two-armed cantilevered support or unweighting system 50 for use with an exercise device, such as a treadmill 10. The unweighting system 50 has a support frame including two uprights 52*a,b* extending vertically from a base (either a separate base or the base of the treadmill 10) and spaced to fit around the treadmill 10. A cantilevered arm 55*a,b* extends from each of the uprights 52*a*, such as at substantially a 90° angle. In some embodiments, each cantilevered arm 55*a*, 55*b* can be configured as a resilient member or leaf spring to unload a portion of the weight of a user while the user exercises on the treadmill. In other embodiments, a spring can be placed underneath the cantilevered arms 55*a,b*, such as within the uprights 52*a,b*, to provide spring force to unweight the user while exercising.

In some embodiments, a user support 56 can be suspended between the two support arms 55*a* and 55*b* of the unweighting system 50. The user support 56 includes a sheet 59 having openings 58*a,b* configured to receive the user's legs. The sheet 59 may be made out of any supple or compliant material to support the user comfortably during use. In some embodiments, the sheet 59 can be a pair of shorts or a form-fitting garment that is pre-attached to the arms 55*a,b*. In some embodiments, in place of the support 56, the ends of the cantilevered arms 55*a,b* can be configured to attach to a user, such as through an attachment mechanism connected to the user's shorts, as described further below.

The cantilevered arms 55*a,b* of system 50 can be height adjustable. In some embodiments, slots 54 in the uprights 52*a,b* can permit a user to attach the cantilevered arms 55*a,b* to the uprights 52*a,b* at the desired height. For example, the cantilevered arms 55*a,b* can be attached to the uprights 52*a,b* at such a height as to position the support 56 directly below the user's groin area. This ensures that the holes 58*a,b* do not interfere with the user's range of motion while allowing the sheet 59 to support the user during exercise. As another example, the cantilevered arms 55*a,b* can be attached to the uprights 52*a,b* at such a height as to position the support 56 around the user's hips, and the sheet 59 can conform around the user's groin area. In other embodiments, rollers can be provided on the cantilevered arms 55*a,b*, and a corresponding track can be located on each of the uprights 52*a,b* to provide for height adjustment of the cantilevered arms 55*a,b*. In some embodiments, the height adjustment mechanism can be controlled by a motor.

In use of the system 50, a user can place his or her legs through the holes 58*a,b* of the support 56, and the cantilevered arms 55*a,b* can be raised to the appropriate position along the uprights 52*a,b*. The user can then exercise (e.g., run or walk) on the treadmill 10 while the cantilevered arms 55*a,b* supply spring force (via the support 56) to unload a portion of the user's weight.

Figure 2:
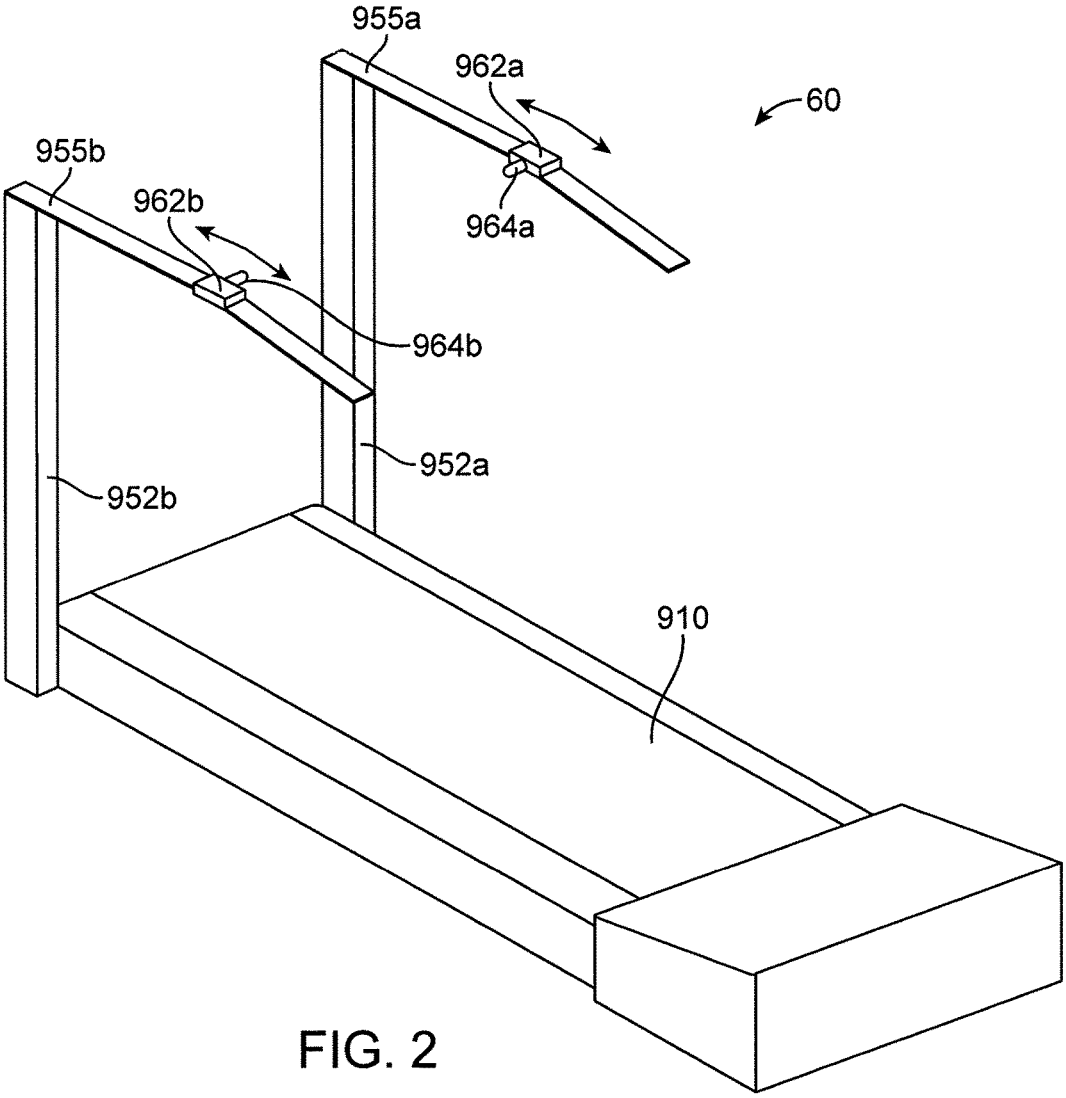
FIG. 2 is a prospective view of another two-armed cantilevered support system.

FIG. 2 is a prospective view of another example of a two-armed cantilevered support or unweighting system 60 for use with an exercise device, such as a treadmill 910. The unweighting system 60 has a support frame including two uprights 952*a,b* extending vertically from a base (either a separate base or the base of the treadmill 910) and spaced to fit around the treadmill 910. A cantilevered arm 955*a,b* is attached to each of the uprights 952*a,b*, such as at substantially a 90° angle. The cantilevered arms 955*a*, 955*b* of system 60 can be configured as resilient members or leaf springs to unload a portion of the weight of a user while the user exercises on the treadmill 910.

The cantilevered arms 955*a,b* of unweighting system 60 can further include a pair of user attachment mechanisms 964*a,b*. The attachment mechanism 964*a,b* can be attachable to the user, such as to a garment worn by the user, as described further below. In some embodiments, the user attachment mechanisms 964*a,b* can be slideable along the cantilevered arms 955*a,b* through sliding elements 962*a,b*. As the sliding elements 962*a,b* move, the spring rate of the cantilevered arms 955*a,b* to the user attached to the attachment mechanisms 964*a,b* changes. That is, the closer that the user is attached to the uprights 952*a,b*, the higher the spring rate. The higher the spring rate, the more that the user's weight can be unloaded for a given vertical deflection. However, the lower the spring rate, the easier it is for the cantilevered arms 955*a,b* to vertically track the user's hips while exercising. The position of the attachment mechanisms 964*a,b* can be selected to balance these features.

In use of the system 60, a user can be coupled to the fixation elements 964*a,b* and sliding elements 962*a,b* can be slid to the desired location along the cantilevered arms 955*a,b*. The user can then exercise on the treadmill 910 as the cantilevered arms 955*a,b* provide spring force to the user to unweight a portion of the user's weight.

Figure 3:
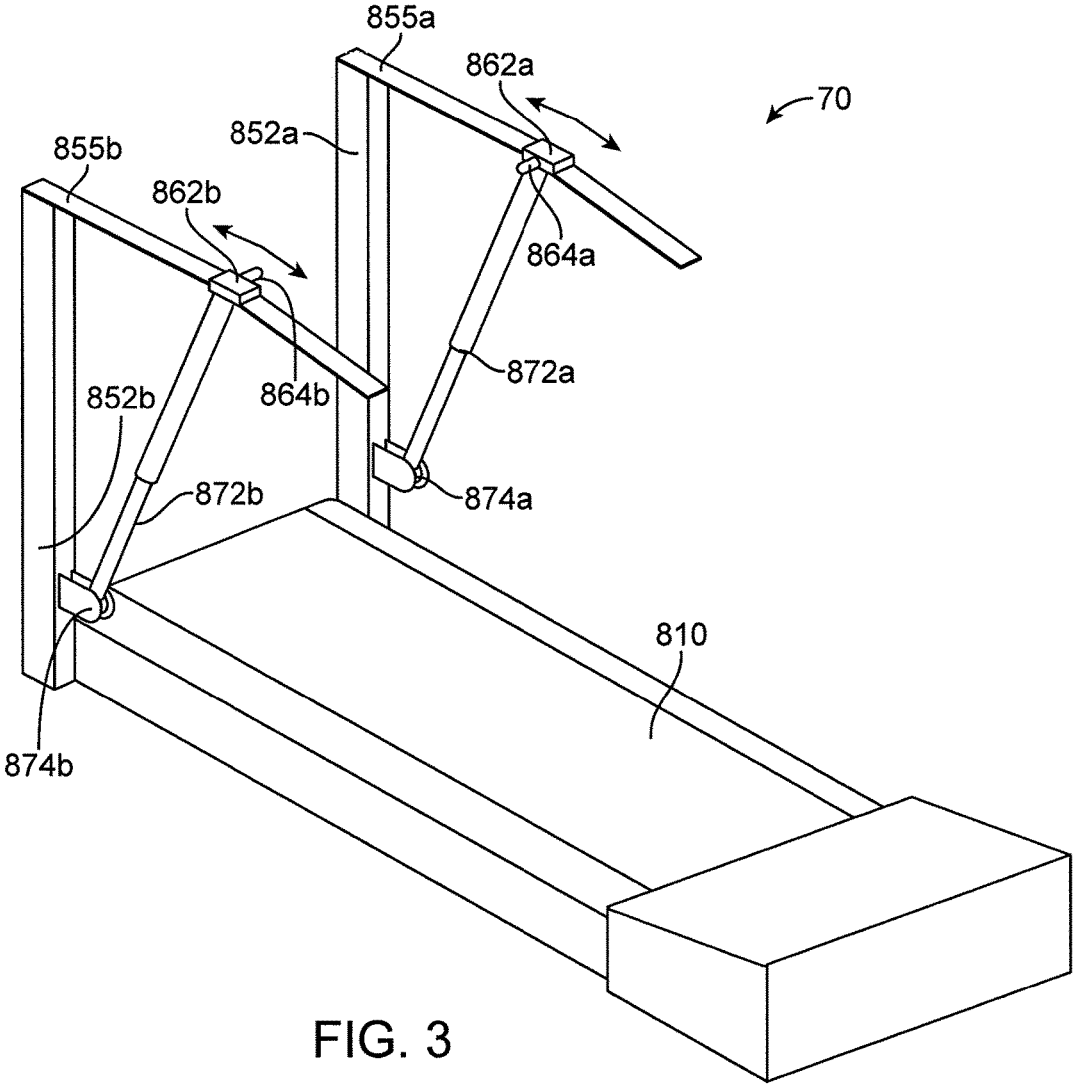
FIG. 3 is a prospective view of another two-armed cantilevered support system.

FIG. 3 is a prospective view of another exemplary two-armed cantilevered support or unweighting system 70 for use with an exercise device, such as a treadmill 810. The unweighting system 70 has a support frame including two uprights 852*a,b* extending vertically from a base (either a separate base or the base of the treadmill 810) and spaced to fit around the treadmill 810. A cantilevered arm 855*a,b* extends from each of the uprights 852*a*, such as at substantially a 90° angle. Similar to the embodiments of FIGS. 1 and 2, the cantilevered arms 855*a,b* can be configured as resilient members or leaf springs to provide an unweighting force for the user. The cantilevered arms 855*a,b* can each include a user attachment 864*a,b* configured to attach to a user. Further, sliding elements 862*a,b* can allow the user attachment 864*a,b* to move along the cantilevered arms 855*a,b*, as described above with respect to FIG. 2.

Unweighting system 70 can further include hinged supports 872*a,b* configured to be placed between a hinged connector 874*a,b* at a base of the uprights 852*a,b* and the sliding elements 862*a,b*. The hinged supports 872*a,b* can pivot about the hinged connectors 874*a,b* as the sliding elements 862*a,b* move along the cantilevered arms 855*a,b*. In some embodiments, the hinged supports 872*a,b* can further be telescoping and/or be otherwise configured to change lengths to compensate for movement of the sliding element 862*a,b* without changing a height of the cantilevered arms 855*a,b*. In other embodiments, the hinged support 72*a,b* may be configured to provide height adjustment at the user attachments 864*a,b* to facilitate attachment, such as to a user garment. The hinged supports 872*a,b* can be further configured to help unload the user's weight when the user is attached to the attachment mechanisms 864*a,b*. In some embodiments, the hinged supports 872*a,b* include a resilient member therein to assist in controllably unweighting the user.

Figure 4:
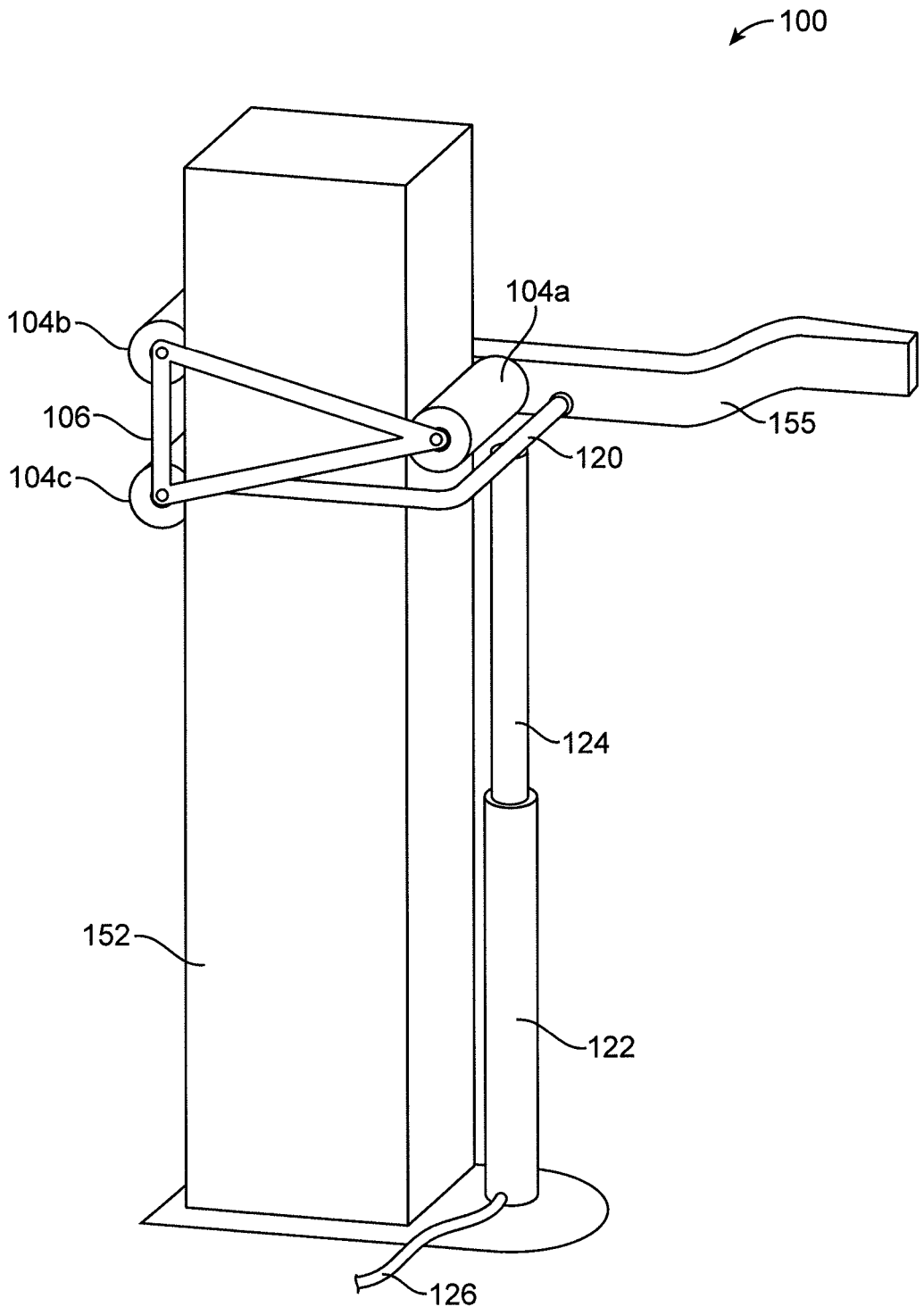
FIG. 4 is a partial view of a hydraulically assisted support system.

FIG. 4 is partial view of another exemplary two-armed cantilevered unweighting system 100 for use with an exercise device. It is to be appreciated that FIG. 4 only shows one side of a system for clarity and that the entire system 100 can include a correspondingly configured hydraulic assist configuration with another support arm to be attached to the other side of the user. As shown in FIG. 4, the unweighting system 100 includes a cantilevered arm 155 coupled to an upright 152.

The system 100 can further include a hydraulic lift system. The hydraulic lift system can include a ram 124, a piston base 122, a lift arm 120 attached to the cantilevered arm 155, and a roller system 106 (including rollers 104*a,b,c*). The hydraulic ram 124 can extend from the piston base 122 to the lift arm 120. A connection line 126 can provide connection to a suitable pneumatic or hydraulic pump that can be used to extend the ram 124 from the piston base 122. Movement of the ram 124 against the lift arm 120 can provide a vertical force against the cantilevered arm 155, allowing the cantilevered arm 155 to slide up the upright 152 using the roller system 106.

In use of the system 100, the user can be coupled to the cantilevered arm 155 through any attachment mechanism described here. To provide for easier attachment, the ram 124 can be retracted so that the lift arm 120 (and thus the cantilevered arm 155) can move freely along the vertical bar 152 through the roller system 106. The user can thus set the cantilevered arm 155 to the desired height. Once the user is attached to the cantilevered arm 155, the ram 124 can be extended to interact with the lift arm 120 and continue to raise the support arm 155 until the user's weight is suitably unloaded and carried by the support arm 155. In some embodiments, the amount of power provided by the pneumatic or hydraulic pump to the ram 124 can be varied, thereby varying an amount of unweighting experienced by the user.

In some embodiments, the cantilevered arm 155 can itself be configured as a resilient member or spring to provide unweighting force for the user instead of or in addition to the hydraulic lift system. In other embodiments, the cantilevered arm 155 can be relatively rigid so as to allow the hydraulic lift system to provide substantially all of the variable unweighting force. Further, in some embodiments, the roller system 106 can be replaced by a suitable lead screw or linear motor arrangement to provide for height adjustment of the cantilevered arm 155.

Figure 5:
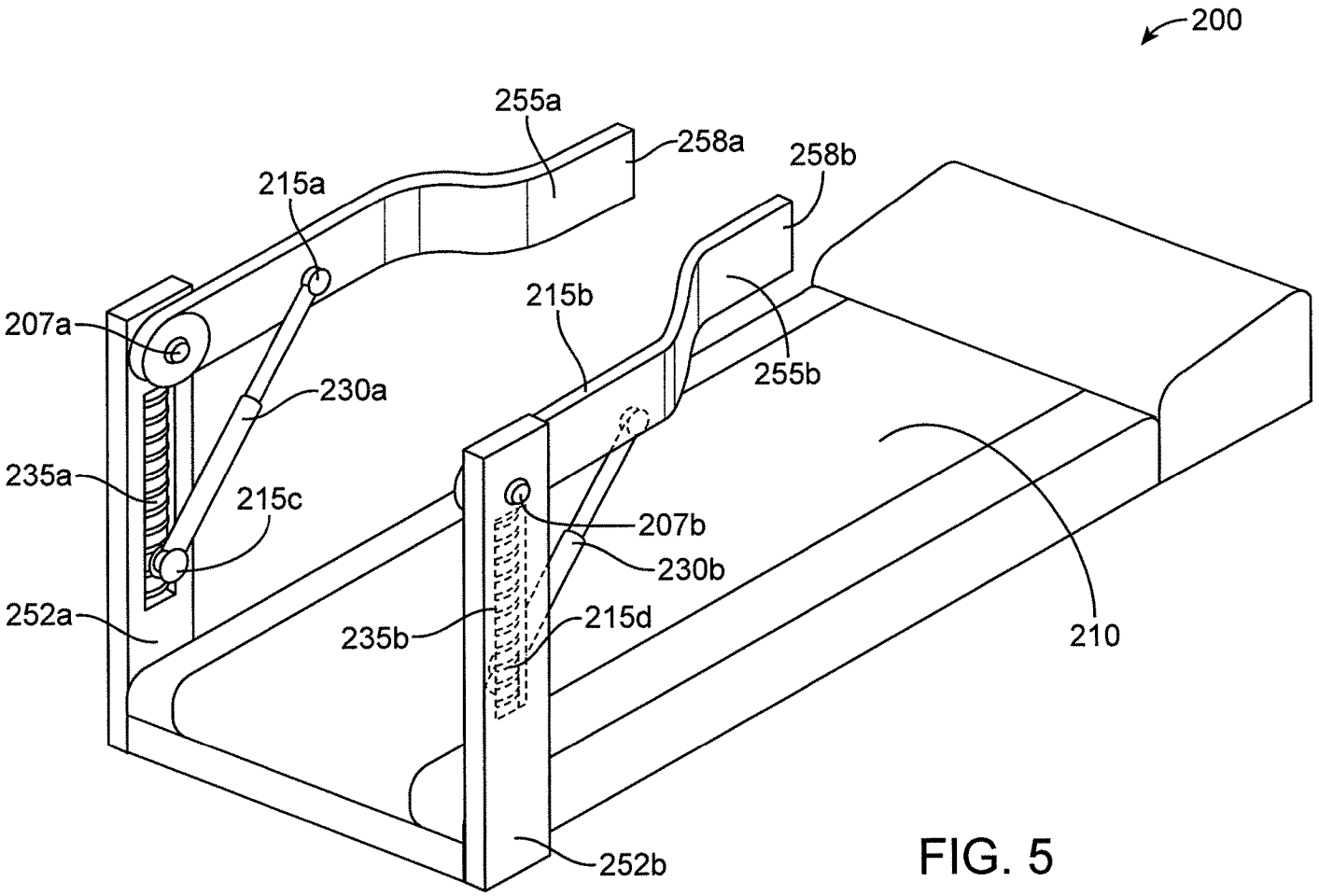
FIG. 5 is a prospective view of a cantilevered spring loaded unweighting system.

FIG. 5 is a prospective view of another exemplary two-armed cantilevered unweighting system 200 for use with an exercise device, such as treadmill 210. The unweighting system 200 has support frame including two uprights 252*a,b* extending vertically from a base (either a separate base or the base of the treadmill 210) and spaced to fit around the treadmill 210. A rigid cantilevered arm 255*a,b* extends from each of the uprights 252*a,b* such as at substantially a 90° angle. A support 230*a,b* can extend from the cantilevered arm 255*a,b* to the upright 252*a,b* and can be connected via upper pin 215*a,b* and lower pin 215*c,d*. In some embodiments, the supports 230*a,b* can be extendable, such as through a telescoping feature. Further, in some embodiments, the cantilevered arms 255*a,b* can be configured to rotate about axels 207*a,b*. Through the extension or rotation of the supports 230*a,b* and/or rotation of the axels 207*a,b*, the height of the distal ends 258*a,b* of the cantilevered arms 255*a,b* can be changed to allow for adjustment to the user.

System 200 can further include a resilient member or spring 235*a,b* in or alongside each of the uprights 252*a,b*. The spring 235*a,b* can be positioned above the lower pins 215*c,d* between the pin 215*c,d* and the axel 207*a,b*. The spring 235*a,b* can be, for example, a coiled spring. In use of the system 200, the spring 235*a,b* can provide lifting force for a user attached to the cantilevered arms 255*a,b* by providing a counterforce to force applied to the lower pin 215*c,d* (such as when a user is loaded onto the distal ends 258*a,b* of the cantilevered arms 255*a,b*).

Figure 6:
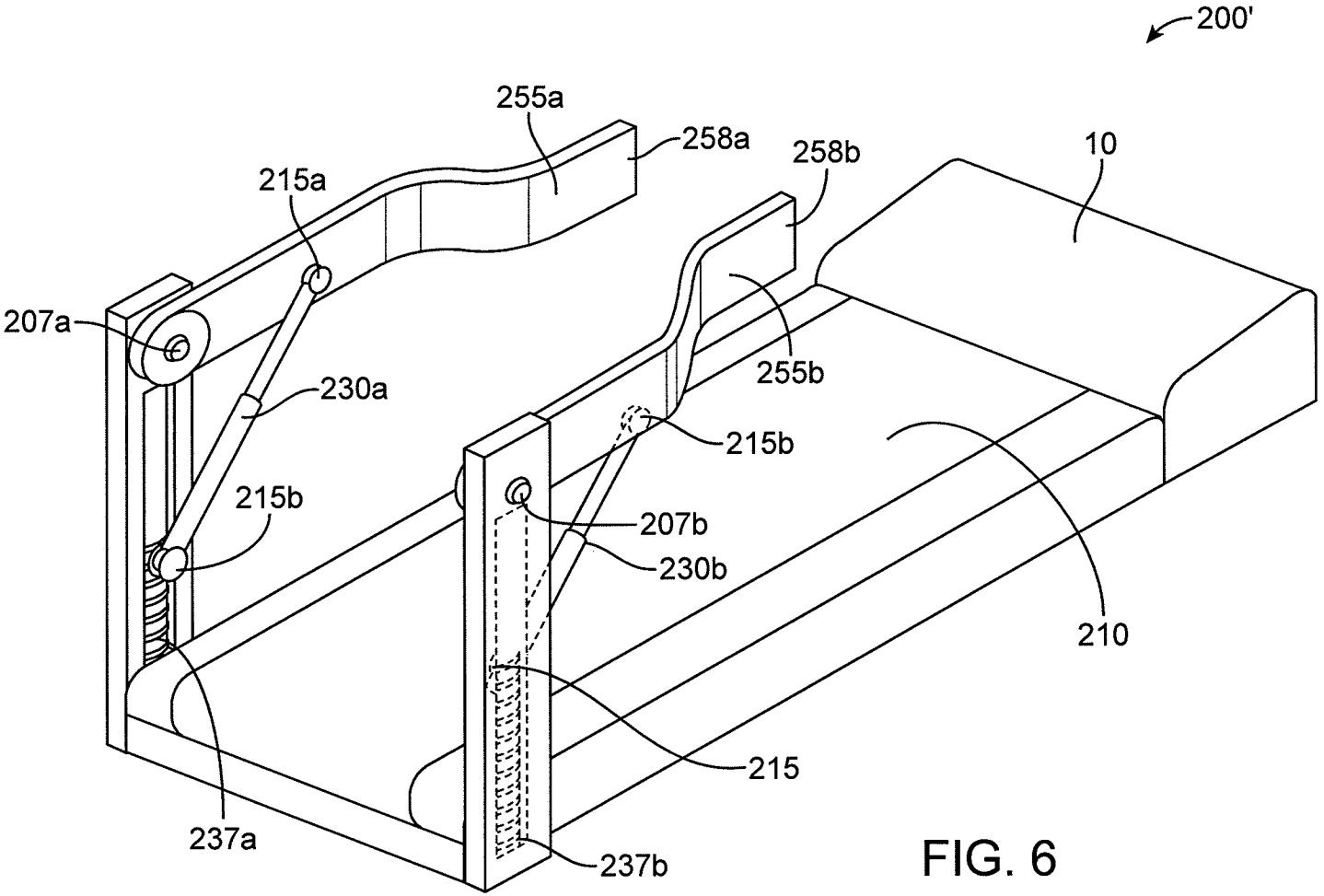
FIG. 6 is a prospective view of an alternative cantilevered spring loaded unweighting systems.

FIG. 6 is a prospective view of an alternative cantilevered spring loaded unweighting system 200'. The system 200' of FIG. 6 is similar to FIG. 5 in all respects except that the position of the spring is reversed. FIG. 6 thus illustrates a compression spring 237*a,b* in position below the pin connection 215*c,d*, whereby the compression force of the spring 237*a,b* acts against the pin 215*c,d* connection to provide support of unweighting to the user attached to the support arm 255*a,b*.

Figure 7:
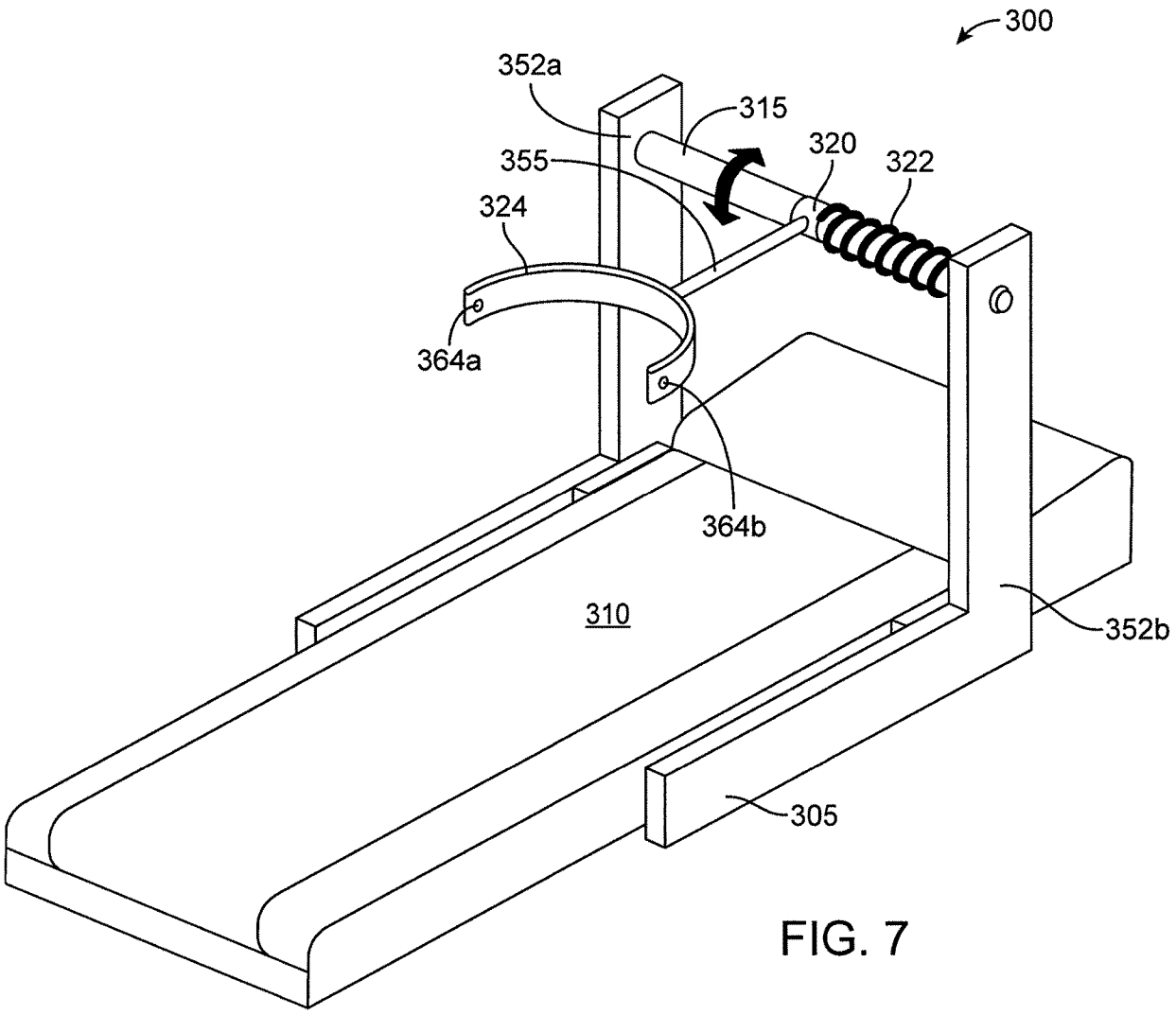
FIG. 7 is a prospective view of a torsion spring based unweighting system.

FIG. 7 is a prospective view of a torsion spring based unweighting system 300 for use with an exercise device, such as a treadmill 310. The unweighting system 300 includes a support frame base 305 attached to a pair of uprights 352*a,b*. A rotatable support axle 315 extends between the uprights 352*a,b*. A collar 320 is attached to the support axle 315. A rigid cantilevered arm 355 extends from the collar 320, and a user ring 324 is attached to the cantilevered arm 355. A torsion spring 322 can extend around the support axle 315 between one of the uprights 352*b* and the collar 320. The ends of the torsion spring 322 can be attached to the upright 352*b* and the collar 320 to provide resistant force when vertical or downward force is placed on the collar 320 by the user. Further, the user ring 324 can be configured to extend at least partially around the user and attach thereto through one or more fixation points 365*a,b*. In use of the system 300, the user is attached to the user ring 324 using fixation points 364*a,b*, and the user's weight can be unloaded by the rotation of the torsion spring 322 about the axle 315 to provide unweighting of the user during use of the treadmill 310. In some embodiments, an adjustment mechanism can be provided to adjust the length of the torsion spring 322 to thereby adjust the amount of unweighting force provided to the user.

Figure 8:
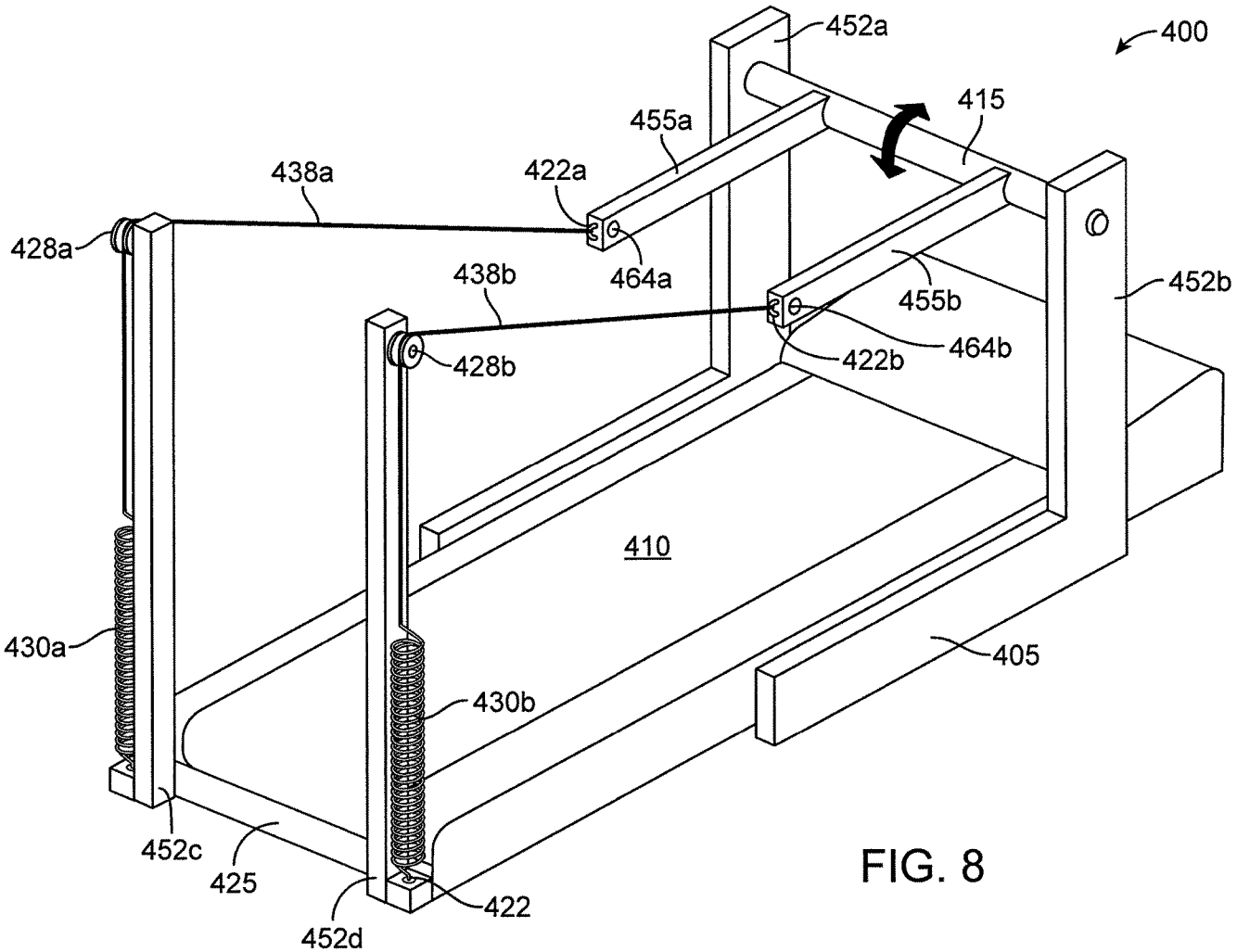
FIG. 8 is a prospective view of a cable assisted cantilevered support system.

FIG. 8 is a prospective view of a cable assisted unloading system 400. The cable assisted unloading system 400 includes a support frame base 405 having front uprights 452*a,b* and rear uprights 452*c,d*. A rotatable support axle 415 extends between the uprights 452*a,b*. A pair of rigid cantilevered support arms 455*a,b* extends from the support axle 415. The cantilevered support arms 455*a,b* include attachment mechanisms 464*a,b* configured to attach to a user. Moreover, a distal end of each of the cantilevered arms 455*a,b* includes a cable attachment point 422*a,b*, and a cable 438*a,b* extends from each cable attachment point 422*a,b*. Each cable 438*a,b* extends around a pulley 428*a,b* attached to a rear upright 452*c,d*. The cables 438*a,b* each end in a resilient member 430*a,b*, such as a coiled spring. The pulleys 428*a,b* can be positioned higher than the support axle 415. Thus, in use of the system 400, when a user is attached to the attachment mechanisms 464*a,b*, the resilient members 430*a,b* can pull on the cable 438*a,b* over pulley 438. As a result, the user can be lifted by the distal ends of the cantilevered arms 455*a,b* to unweight the user. In some embodiments, a shock absorber or dampening mechanism can be used to provide dampening to the movement of the cantilevered arms 455*a,b* as the user moves up and down (such as while running).

FIGS. 10-18 illustrate an exemplary coiled spring unweighting system 600 for use with a treadmill 610. The unweighting system 600 includes a base having legs 604*a,b* configured to extend along the side of the treadmill 610 and a cross-member 602 configured to extend along the rear of the treadmill 610. A pair of vertical uprights 652*a,b* extend from the base. Further, a cantilevered arm 655*a,b* extends from each of the uprights 652*a,b*. The cantilevered arms 655*a,b* can be configured to attach to a user for unweighting, as discussed further below. In some embodiments, slanted supports 661 *a,b* can extend at an angle between the cross-member 602 of the base and the uprights 652*a,b*, and slanted supports 663*a,b* can extend at an angle between the legs 604*a,b* of the base and the uprights 652*a,b* to provide additional structural support for uprights 652*a,b*.

Further, attached to the uprights 652*a,b* is a series of assemblies that can be used to control the user fit and degree of unweighting of a user attached to the system 600. One subassembly is the height adjustment subassembly 620*a,b* attached to the uprights 652*a,b*. Attached adjacent to the height adjustment subassembly 620*a,b* is the spring support subassembly 640*a,b*. At the distal end of the support arm 610 is the user attachment and width adjustment assembly 660. Each one of these assemblies will be described in detail as follows.

Each height adjustment subassembly 620*a,b* includes a lead screws 624*a,b*, lead nuts 626*a,b*, linear bearings 622*a,b,c,d*, and a motor 628*a,b*. The linear bearings 622*a,b* can be connected to the lead nuts 626*a,b* and can be configured to slide along the corresponding upright 652*a,b*, such as along a track in the upright 652*a,b*. The motor 628*a,b* can be configured to turn the lead screw 624*a,b*. As a result, the lead nut 626*a,b* can move, thereby changing the height of the arm assembly 655*a,b*, which is coupled with, and thus pulled along by, the linear bearings 622*a,b*. In use, the cantilevered arms 655*a,b* can be set by the user to a desired height, such as near the user's hips, using the motors 628*a,b* to control the height adjustment subassembly 620*a,b*. In some embodiments, there can be two motors 628*a,b* in the system 600—(one for each lead screw 624*a,b*), while in some embodiments, a single motor can be used.

The spring support subassembly 640*a,b* is includes a support structure including a support beam 650*a,b* and a support column 642*a,b*. The support structure is connected to the linear bearings 622*a,b,c,d* through hinges 640*a,b,c,d* (discussed further below). Further, the cantilevered arms 655*a,b* are connected to the support column 642*a,b* of the support structure through a hinge 644*a,b*. A spring 646*a,b*, such as a coiled spring, extends between the support beam 650*a,b* and the cantilevered arm 655*a,b*. The spring 646*a,b* extends over a lead screw 647*a,b*, which is connected to the support arm 655*a,b* through a top hinged block assembly 648*a,b* and to the support beam 650*a,b* through a bottom hinged block assembly 648*c,d*. In some embodiments, one or more bushings 641*a,b* (see FIG. 15) can be placed around the spring and/or lead screw. In use, the spring support subassembly 640*a,b* can apply unweighting force to a user attached to the cantilevered arms 655*a,b*. The amount of force applied by the spring 646*a,b* can be varied by rotating the lead nut 645*a,b* relative to the lead screw 647*a,b*, thereby changing the spring length (the shorter or more compressed the length of the spring 646*a,b*, the greater the force). In some embodiments, the length of the spring 646*a,b* can be controlled by a motor, such as a motor configured to rotate the nut 645*a,b* or the screw 647*a,b*. In some embodiments, the hinged block assembly is slideable along the cantilevered bar 655*a,b* in order to change the effective spring rate of a user who is attached to the arm 655*a,b*.

Figure 17:
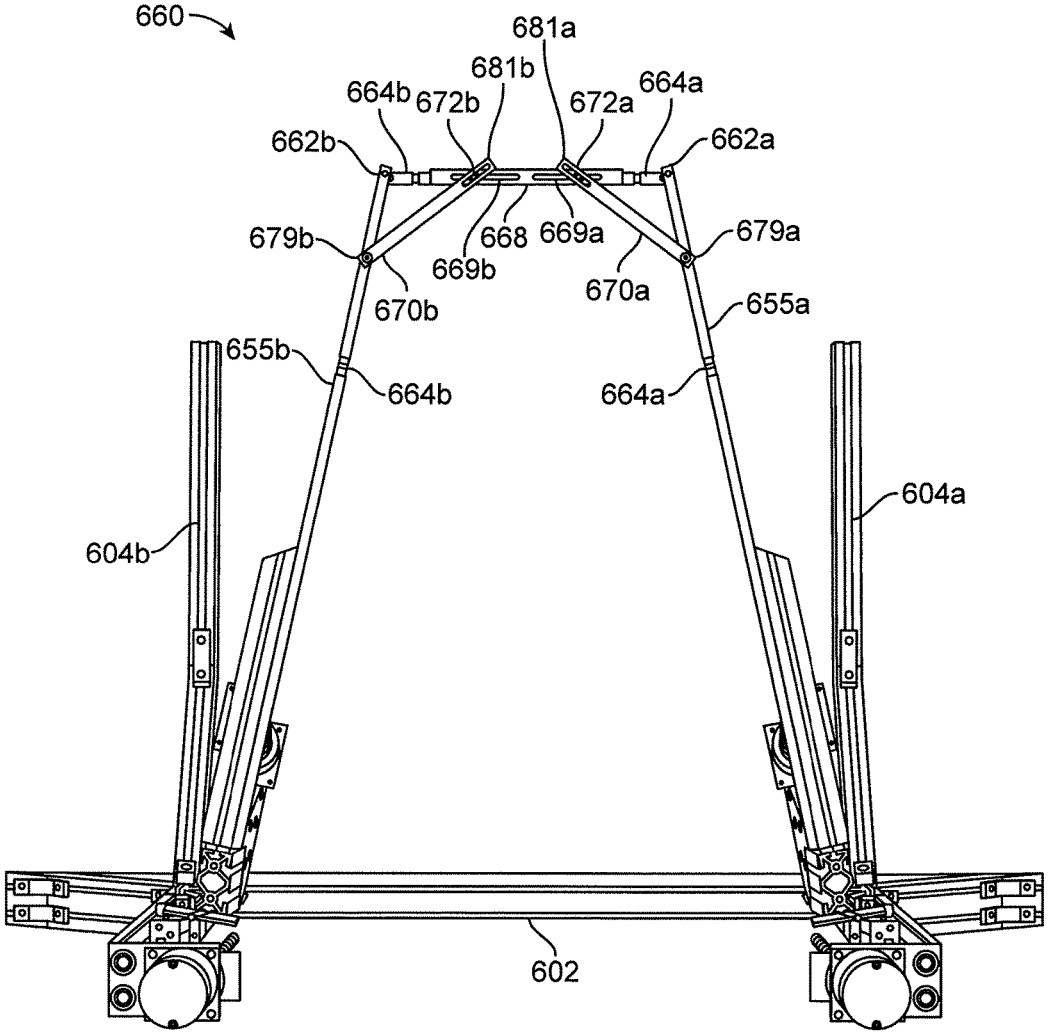
FIG. 17 is a top view of the coil spring assisted unweighting system of FIG. 10 enlarged to show the detail of the user attachment and width adjustment assembly.
Figure 18:
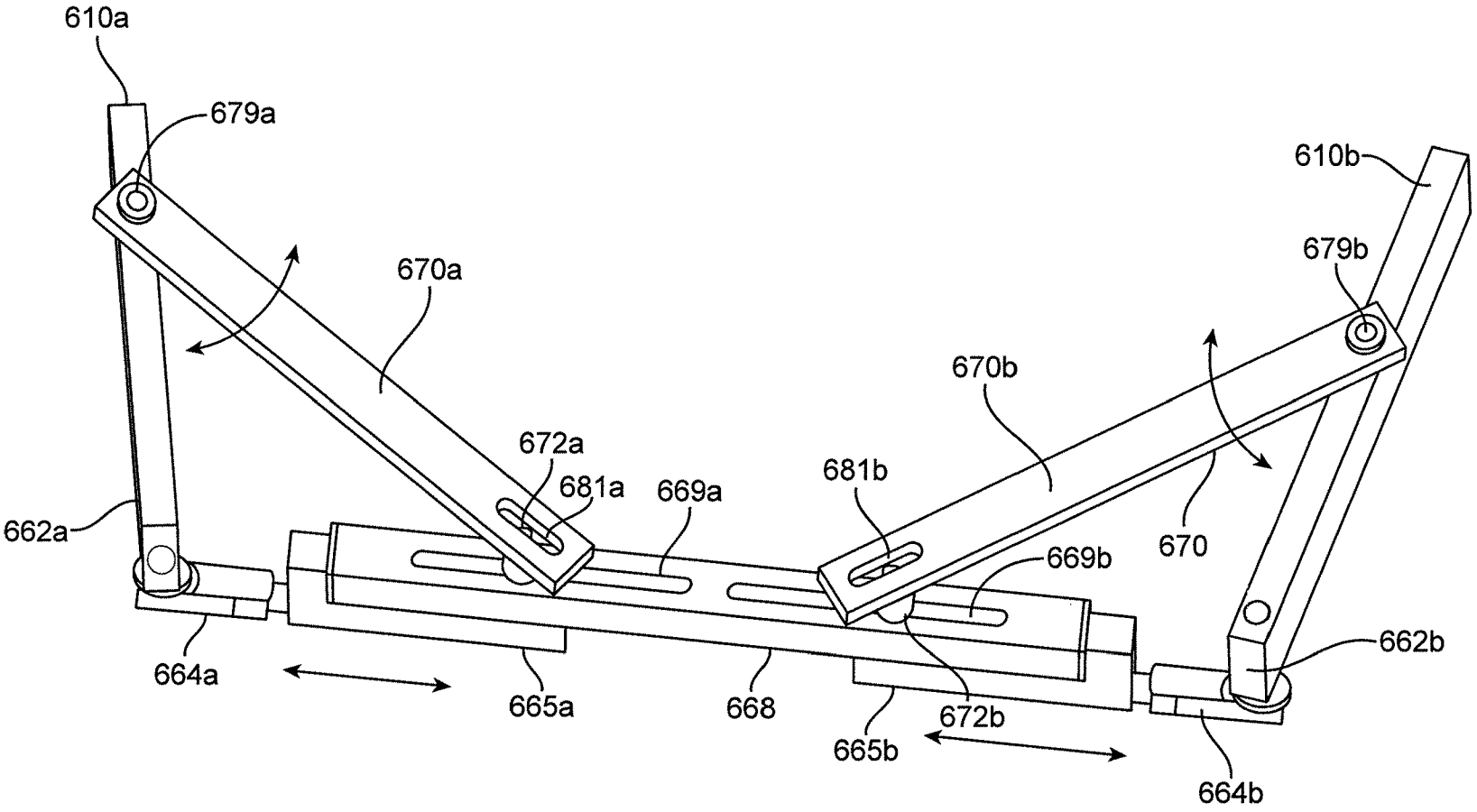
FIG. 18 is a front prospective view enlarged to show the detail of the user attachment and width adjustment assembly of FIG. 17.

The user attachment and width adjustment subassembly 660, shown in close-up in FIGS. 17 and 18, includes a swivel coupling 644*a,b* attached to the distal end of each of the cantilevered arms 655*a,b*. As shown in FIG. 18, the connection between the swivel couplings 644*a,b* and the cantilevered arms 655*a,b* can be through a ball joint that can advantageously allow relative vertical movement between the cantilevered arms 655*a,b* and the swivel couplings 644*a,b* while limiting lateral movement (thereby providing for better tracking of the user's vertical movement during running or walking). The swivel couplings 644*a,b* are attached to a dual guide channel 668. The dual guide channel includes slots 669*a,b* to receive a locking clamp 672*a,b* (which is attached to a support block 665*a,b* as shown in FIG. 18). Further, diagonal braces 670*a,b* are attached to each cantilevered arm 655*a,b* at a hinge point 679*a,b*. The distal end of each of the diagonal braces 670*a,b* includes a slot 681*a,b* configured to interact with the locking clamp 672*a,b*.

In use, the width adjustment assembly 660 can be configured to adjust the width between the distal ends of the cantilevered arms 655*a,b*, and thus to provide for attachment of the users of varying widths. To make the width smaller, for example, the locking clamp 672*a,b* can be loosened and slid laterally inwards along the slots 669*a,b*. As the locking clamp 672*a,b* moves laterally inwards, the swivel couplings 644*a,b* will likewise move inwards, thereby pulling the cantilevered arms 655*a,b* inwards. Further, pulling the locking clamp 672*a,b* laterally inwards will cause the distal ends of the diagonal branches 670*a,b* to likewise move laterally inwards (via connection of the slot 681*a,b* to the locking mechanism 672*a,b*). The proximal ends of the diagonal braces 670*a,b* can pivot about the hinge point 679*a,b* to compensate for the movement of the cantilevered arms 655*a,b* and the distal ends of the diagonal braces 670*a,b*. Movement in the opposite direction can occur when a greater distance is needed between the arms 655*a,b*.

In some embodiments, the elements of the width adjustment assembly 660 can provide lateral stability for the user. That is, by connecting the arms 655*a,b*, the user can be better contained to the center of the exercise device. Further, the connection between the arms 655*a,b* can reduce the amount of swaying or lateral movement caused by individual arms 655*a,b* as the user runs or walks on the exercise device.

The sides of the user, such as opposite hips of the user, can be attached to an attachment mechanism 664*a,b* located between the proximal and distal ends of the cantilevered arms 655*a,b*. The attachment mechanism 664*a,b* can be a slot, groove, or track. In one aspect, a hook on a user garment is coupled into a slot, groove or track along the inside surface of the arms 610 (i.e., the face of the arms closest to the user). The width adjustment subassembly 660 can advantageously both help set the distance between the arms 655*a,b* and provide additional structural support to prevent too much lateral movement, thereby enhance stability of the user during exercise.

Alternative attachment mechanisms to width adjustment subassembly 660 are possible. For example, the width adjustment subassembly 660 can be removed entirely, allowing the user to move free with only the constraint of having his or her shorts (or other harness or garment) connected to the cantilevered arms 655*a,b*. In some embodiments, springs can be used to apply inward pressure to the cantilevered arms 655*a,b*. In some embodiments, the user can select a fixed width between the cantilevered arms 655*a,b*. In some embodiments, the user can select a fixed width between the arms 655*a,b*. Further, diagonal braces can be used to prevent significant lateral movement and/or allow only a set amount of lateral movement. Some, all, or combinations of these various configurations may be provided by removing or modifying the width adjustment subassembly 660 described herein.

Overall, in use of the system 600, the user can set the height of the cantilevered arms 655*a,b* at a position convenient for connecting the user's hips to the cantilevered arms 655*a,b* using the height adjustment subassembly 620*a,b*. Further, the user can adjust the width between the cantilevered arms 655*a,b* using the width adjustment subassembly 660. Further, the user can adjust the spring force of the spring subassembly 640*a,b*, e.g., by compressing the spring 646*a,b*, which results in an upward force that decreases the effective weight of the user.

Figure 9:
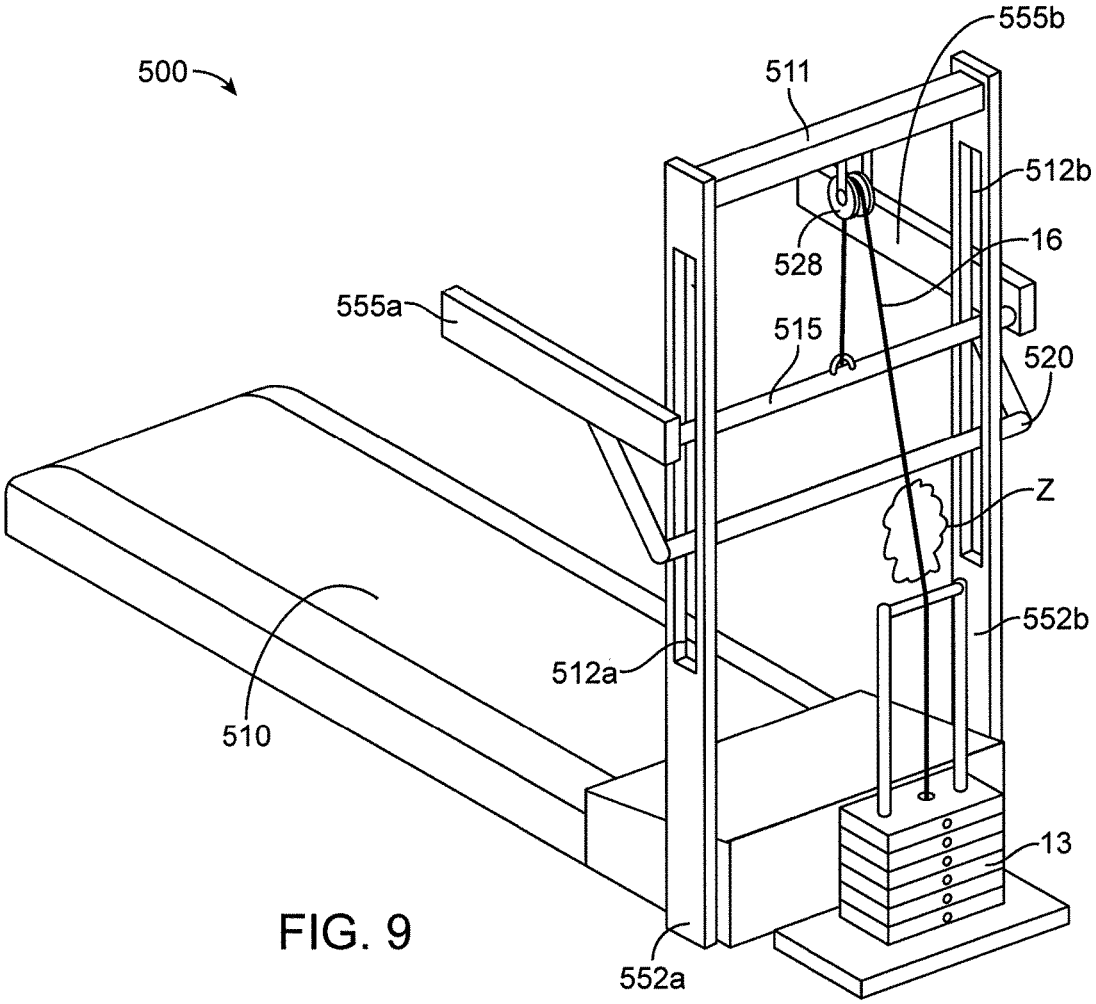
FIG. 9 is a prospective view of a weight stack assisted unloading system.

FIG. 9 is a prospective view of a weight stack assisted unweighting system 500 for use with a treadmill 510. The weight stack assisted unweighting system 500 includes a support frame having uprights 552*a,b*, each with a vertically extending slotted opening 512*a,b*. An upper cross-member 511 extends between the uprights 552*a,b*. Further, a pair of rigid cantilevered arms 555*a,b* is coupled to the uprights 552*a,b* through a guide bar 515 and an antirotation bar 520, each of which extend through the slotted openings 512*a,b*. A pulley 528 is attached to the upper cross-member 511. Further, a weight stack 13 is attached via a cable 16 to the guide bar 515 through the pulley 528. In use of the system 500, a user attached to the cantilevered arms 555*a,b* can be unweighted as the weight stack 13 pulls on the guide bar 515 (thereby lifting the cantilevered arms 555*a,b*). The antirotation bar 520, because it is attached to the arms 525*a,b* while also being positioned within the slots 512*a,b*, prevents the force from the weight stack 13 from rotating the arms 555*a,b*. The amount of weights used on the weight stack 13 can be varied, thereby controllably varying the amount of unweighting experienced by the user.

Figure 9A:
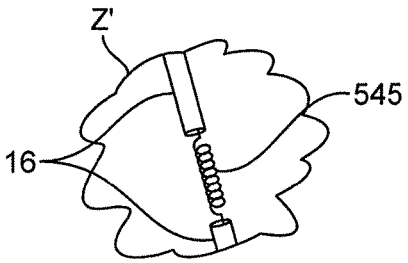
FIG. 9*a* shows spring adapted cable.

In one embodiment, illustrated in FIG. 9*a*, a spring 545 is provided in the cable 16. The spring 545 is provided with a spring constant to provide a dampening function between the weight of the weight stack 13 and the vertical movement of a runner attached to the support arms 555*a,b*. In another alternative embodiment, illustrated in FIG. 9*b*, an absorber unit 550 is attached to the cable 16 similar to the way described for spring 545. The absorber unit 550 may be a shock absorber or other dampening unit that is provided to the cable 16 in order to provide dampening of the weight stack 13 and the vertical movement of the user during exercise.

Figure 9B:
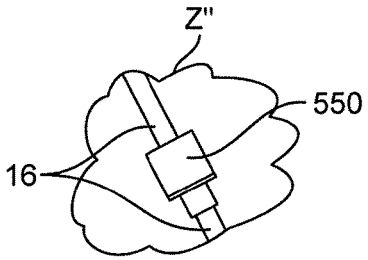
FIG. 9*b* is a hybrid spring cable having a damper system.
Figure 10:
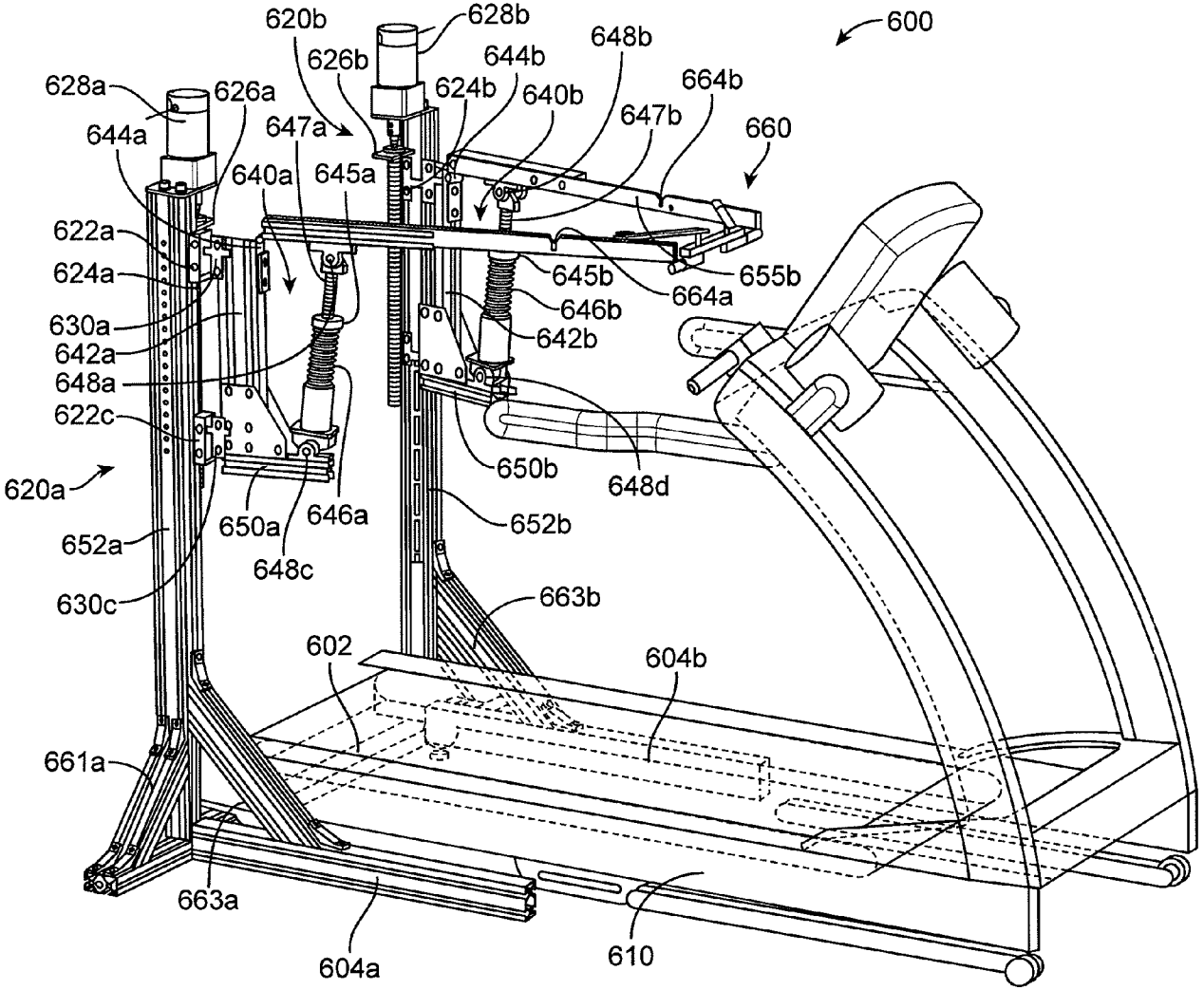
FIG. 10 is a prospective view of a coil spring assisted unweighting system in position for assisted use with a treadmill.
Figure 11:
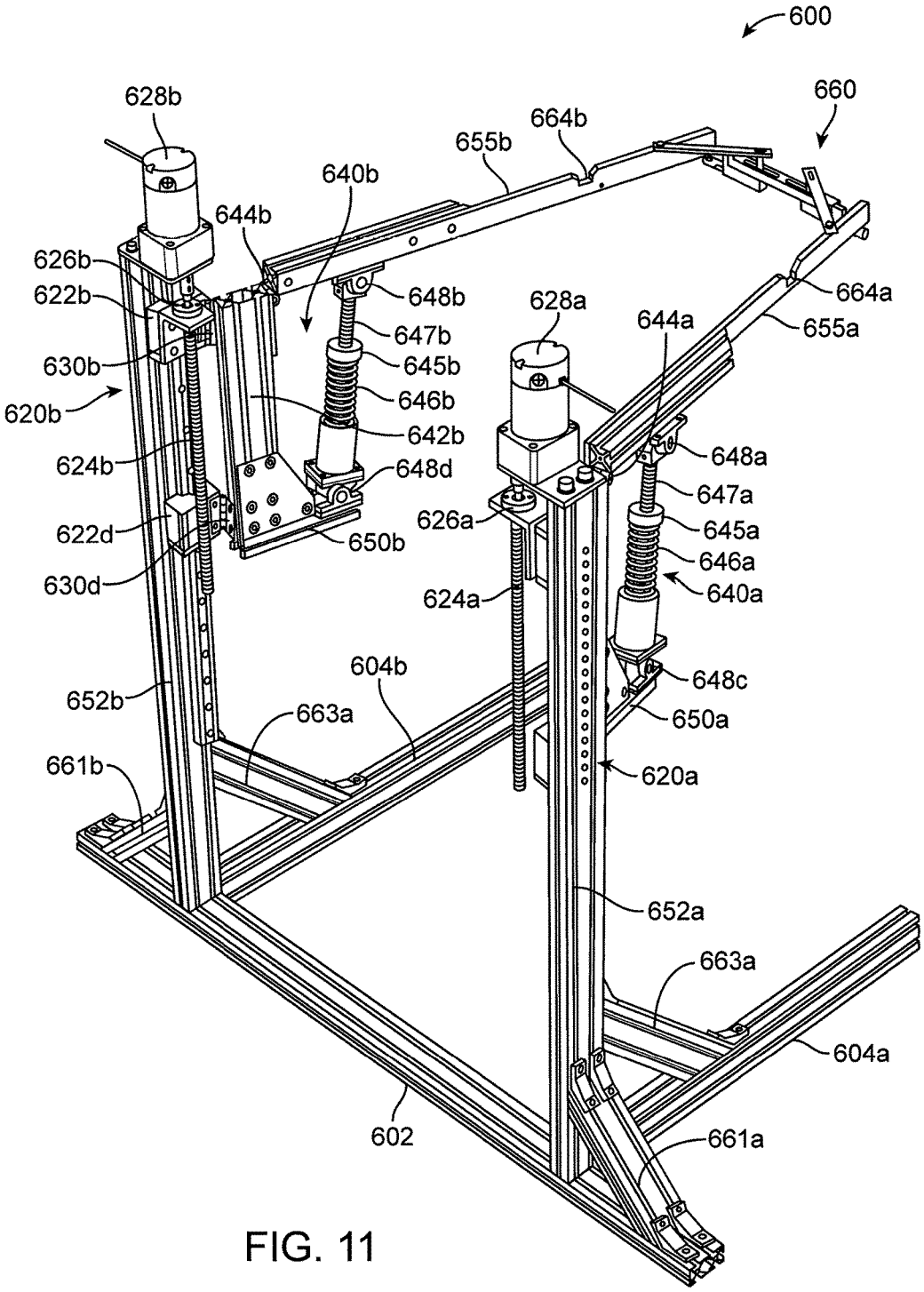
FIG. 11 is a rear prospective view of the coil spring assisted unweighting system of FIG. 10.
Figure 12:
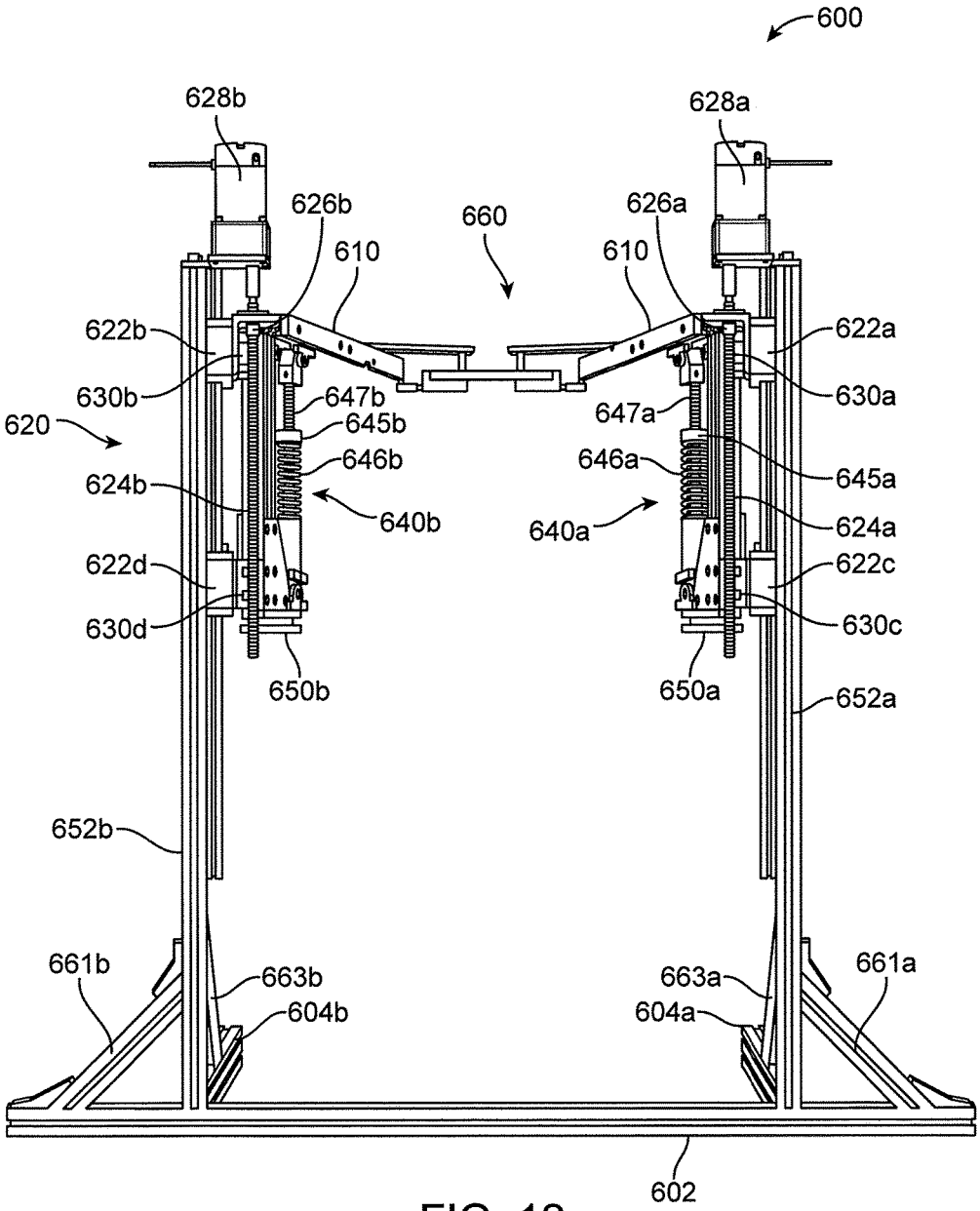
FIG. 12 is a rear view of the coil spring assisted unweighting system of FIG. 10.
Figure 13:
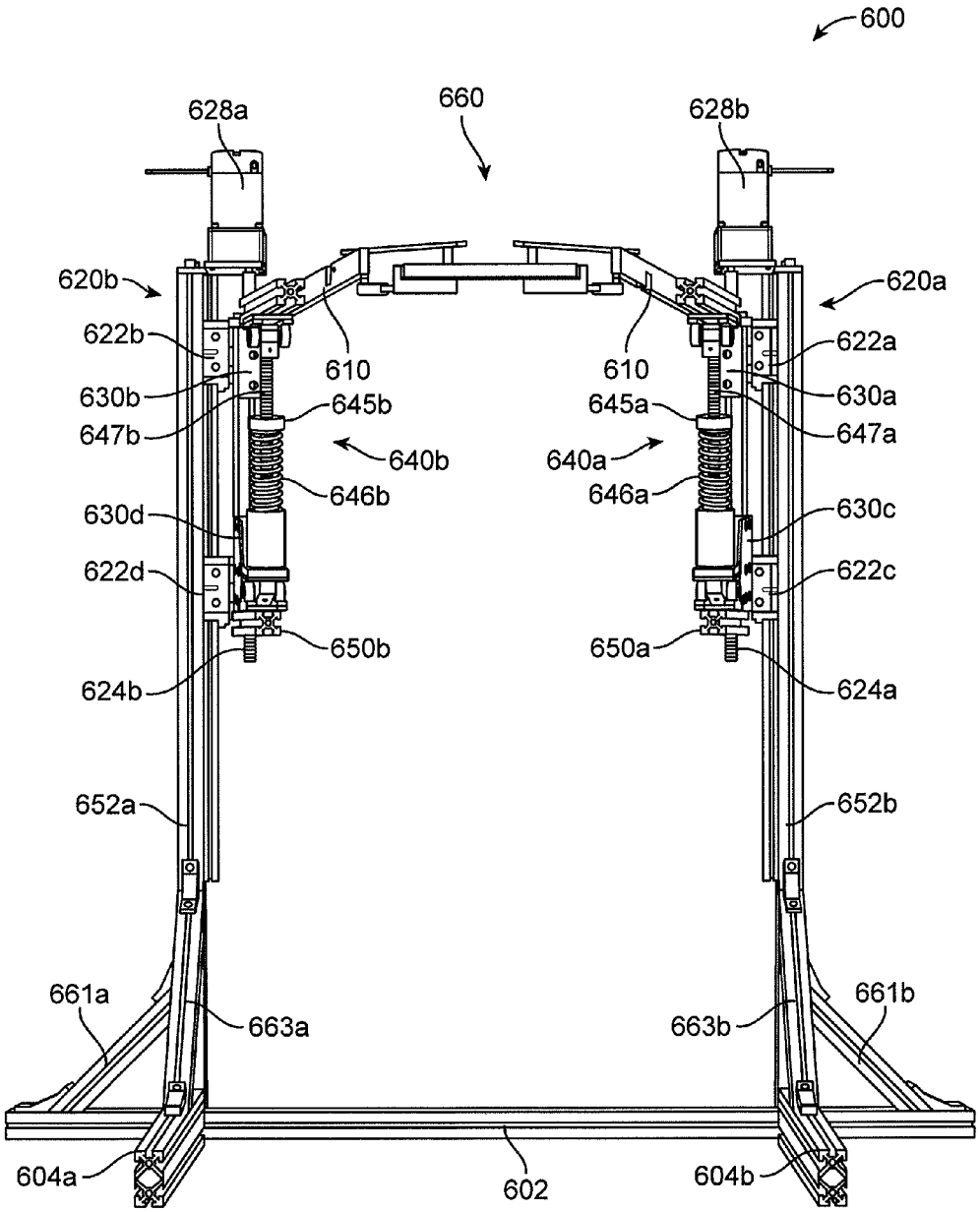
FIG. 13 is a front view of the coil spring assisted unweighting system of FIG. 10.
Figure 14:
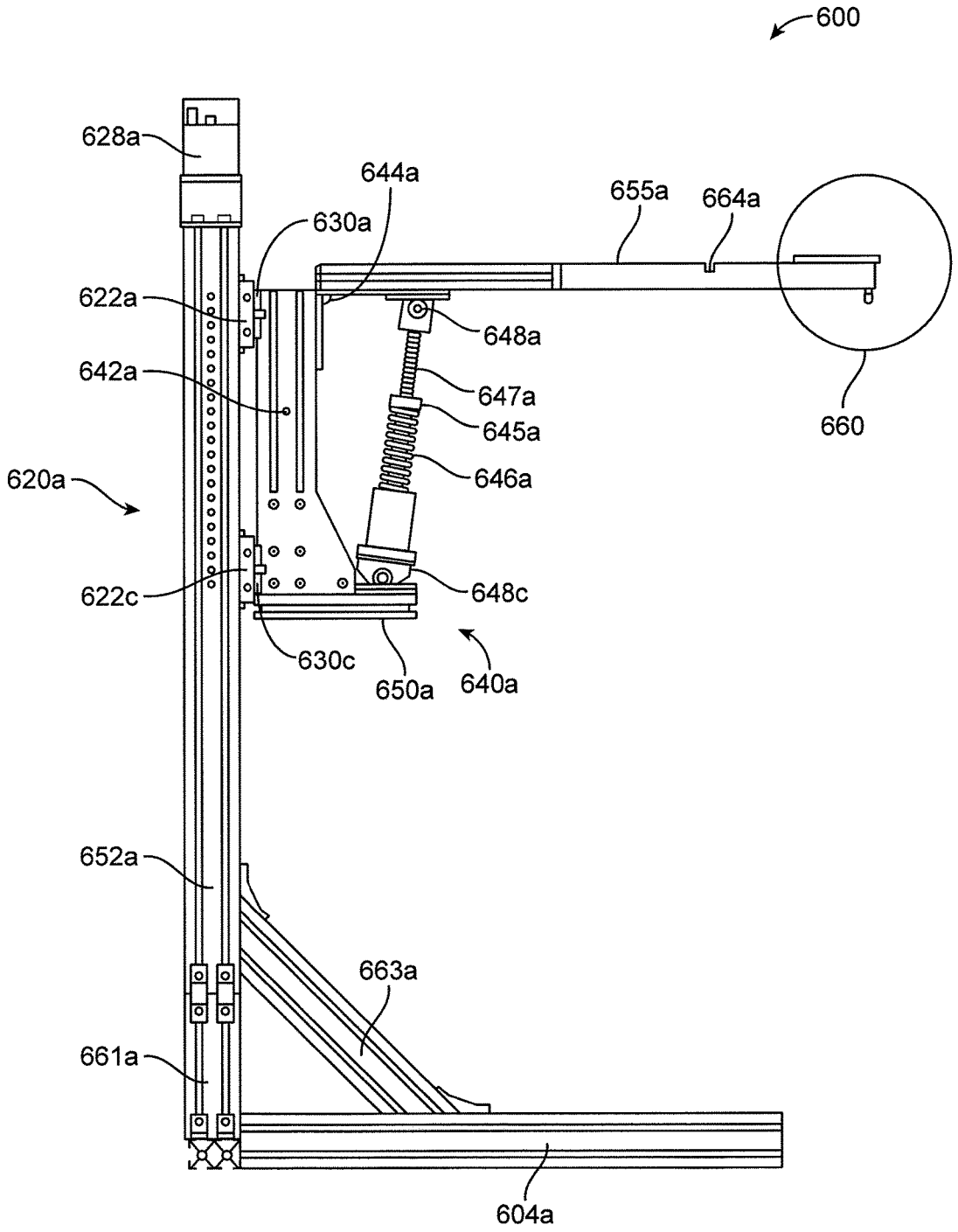
FIG. 14 is a side view of the coil spring assisted unweighting system of FIG. 10.
Figure 15:
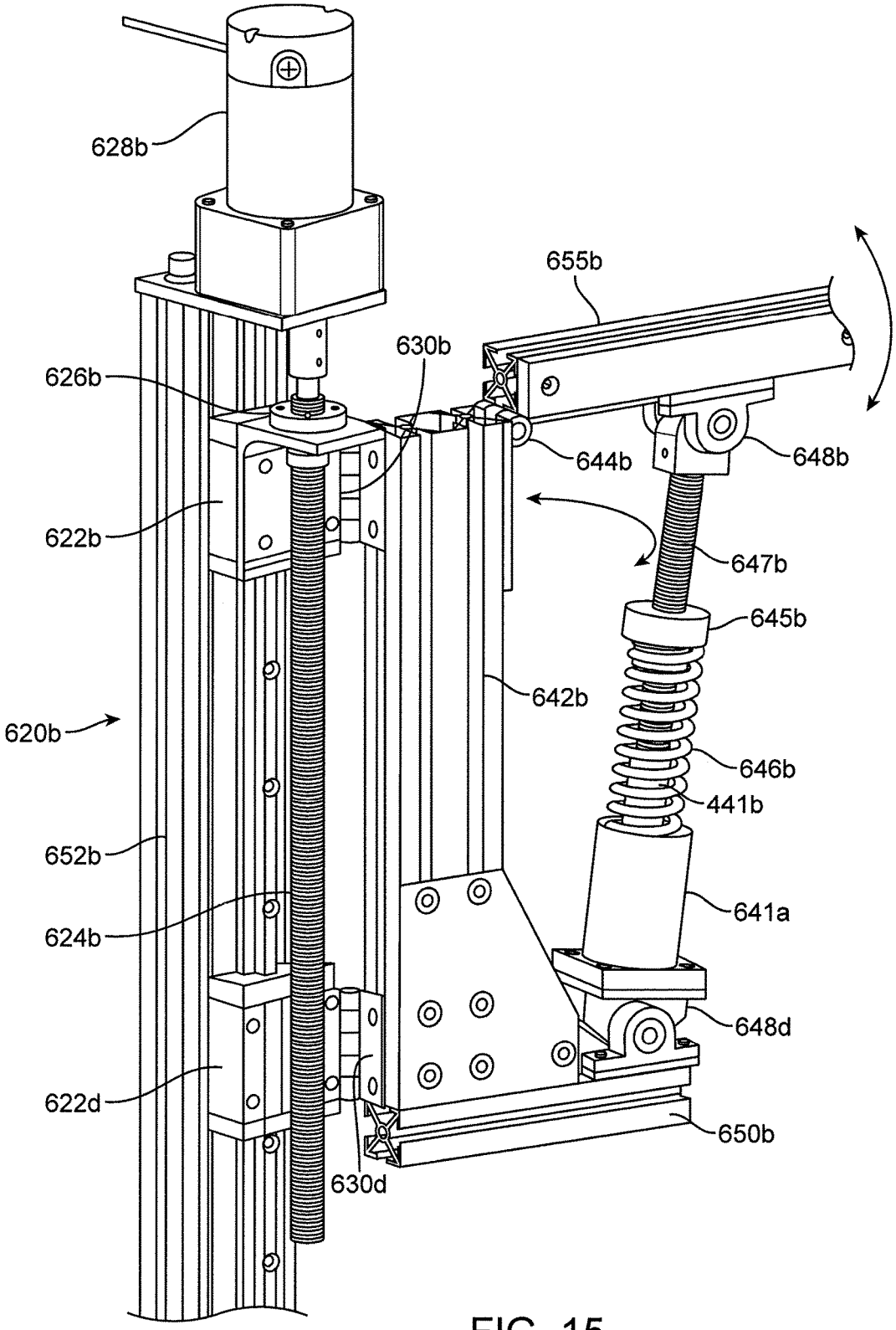
FIG. 15 is a close-up view of the interaction between the height adjustment and compression assembly and the spring support assembly of the coil based unloading system of FIG. 10.
Figure 16:
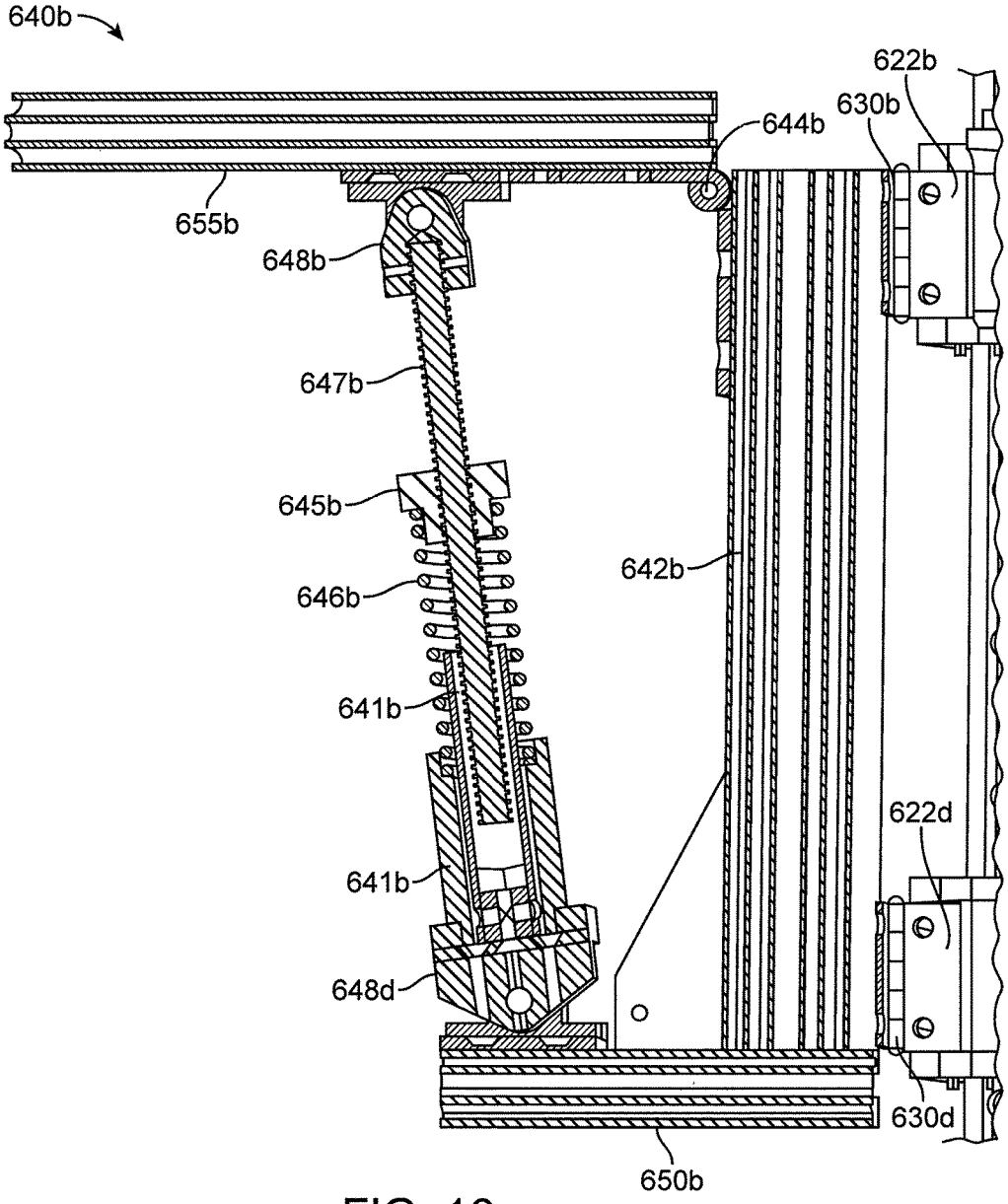
FIG. 16 is a cross-sectional enlarged view of the spring support assembly of FIG. 10.

While desiring not to be constrained by theory, it is believed that the vertical movement of a runner's hips is about 2 Hz. In the embodiment of FIG. 9, the user is directly connected to the weight stack 13, and, as a result, the weight stack 13 will also be impacted by the up and down hip motion. In one alternative embodiment, the resilient members or tuning devices of FIGS. 9*a* and 9*b* are selected to have a response or spring constant selected to dampen out or attenuate the up and down hip motion of the user. In such a tuned system, the weight stack 13 will provide the desired about of unweighting, and a tuned hip motion response element accommodates for user hip motion. In another aspect, the tuned hip motion response element also has a response characteristic not only to accommodate hip motion, but to also be able to maintain that response characteristic over the range of weights used in weight stack 13. In still other alternatives, the tuned response element may be connected in line with cable 16 (as shown in FIGS. 9*a* and 9*b*) or directly on top of the weight stack 13 or part of the weight stack frame or different tuned response elements may be provided for each weight stack increment. In an embodiment such as this, the weight stack amount and tuned response element for that weight stack 13 is pre-determined and automatically selected for each weight stack unweighting increment. In view of the above, it is to be appreciated that one or more of the selectively responsive element or elements may be positioned along the cable at any selected location based on system design parameters or, alternatively, attached directly to, adjacent or integral with the load stack.

Figure 19A:
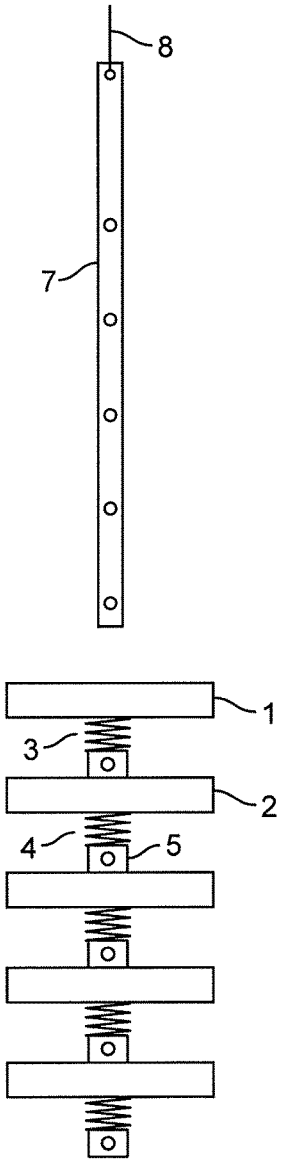
FIGS. 19A, 19B and 19C are various views of a weight stack for use in unweighting a runner with a dampened response.
Figure 19B:
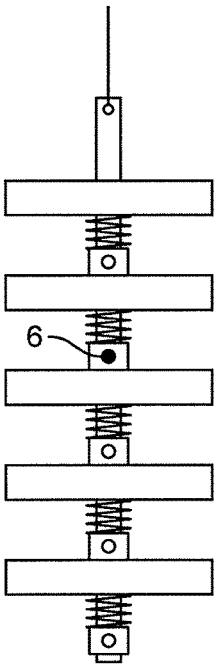
Figure 19C:
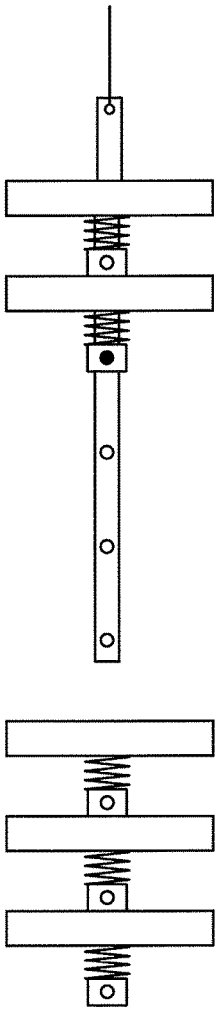

FIGS. 19A, 19B and 19C are various views of a weight stack for use in unweighting a user (such as with system 500) attached to an unweighting cable 8 such that a dampened response occurs. To decouple the weight stack's inertia from the user, compliant members (such as springs 3,4 labeled in FIG. 19A) are introduced between the weight stack and the user. Further, the compliant members have a spring rate K, which is governed by the equation F>SQRT (K/M), where M is the mass being isolated and SQRT(K/M) is the natural frequency of the spring mass system being excited. The configurations illustrated in FIGS. 19A, 19B and 19C are but one possible configuration. As best seen in FIG. 19A, the mass of lifting rod 7 would be minimized as it couples directly to the user. Spring rate K for spring 3 would be chosen based on the equation above and the mass of top weight 1. Spring rate K for spring 4 would be chosen roughly based on the equation above and the masses of both weights 1 and 2. It can also be appreciated that damping can be added to the system as well to further minimize the effects of weight stack inertia (see FIGS. 17 and 18, for example). A parallel embodiment can also be envisioned where weight/spring pairs are lifted separately instead of in a stack and where the K/M ratios are the same for each weight/spring pair. For more accurate tuning of the K/M ratios, Finite Element Analysis can also be used to analyze more complex vibration modes beyond the first order modes predicted by the equation above.

Figure 20A:
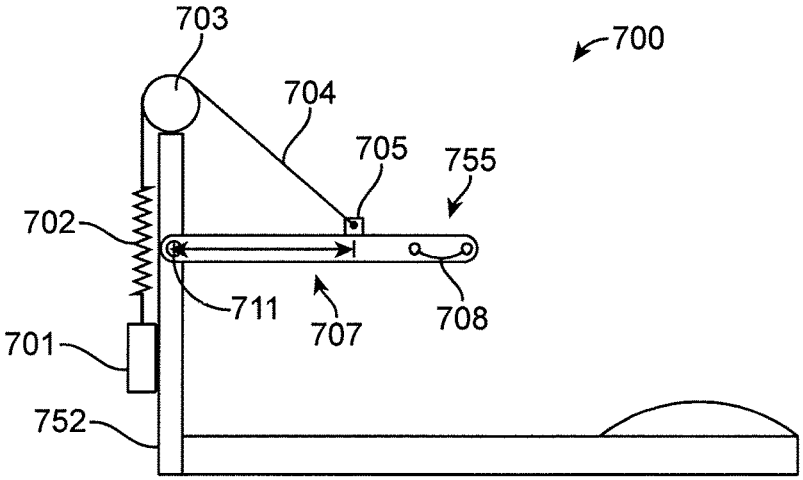
FIGS. 20A, 20B and 20C provide three views of a single weight unweighting system.
Figure 20B:
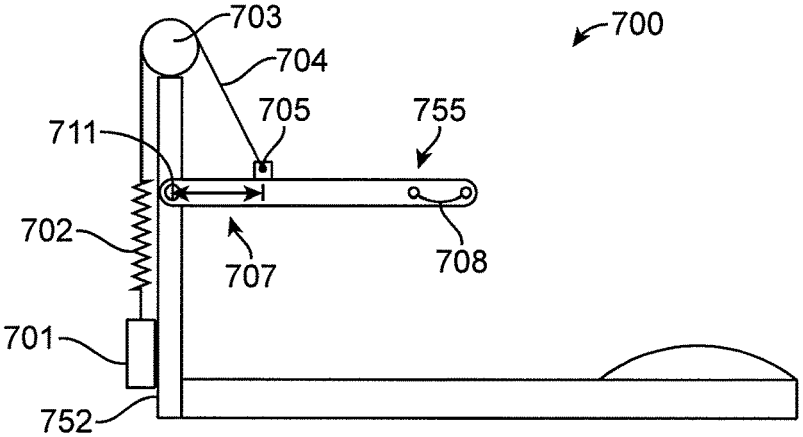
Figure 20C:
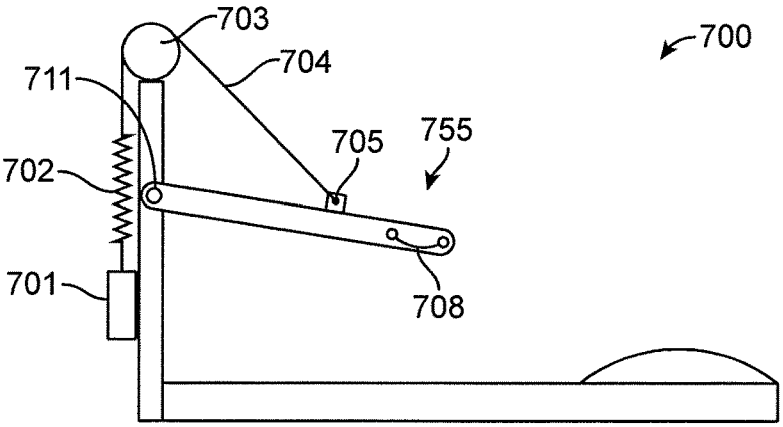

FIGS. 20A, 20B and 20C illustrate the use of a single weight stack unweighting system 700, which is similar to system 500 of FIG. 9. In the illustrative system, there is a reduction in the unweighting architecture to a minimum while maintaining the necessary functionality. Height adjustability for different users is enabled through the rotation of arm 755 relative to upright 752 around pivot point 711. Weight 701 and isolation element 702 are attached to a cable 704, which extends over a pulley 703 from an attachment cleat 705 connected to the cantilevered arm 755. The weight 701 and isolation element 702 move up and down as arm angle is adjusted, providing the same decoupled isolation force throughout the range of motion. Unweighting force of a user attached to attachment point 708 is varied by moving attachment cleat 705 along arm 755, varying distance 707 to vary the mechanical advantage of weight 701. Also shown in this embodiment is the sliding hip coupling described in greater detail with regard to FIGS. 23A, 23B.

Figure 21:
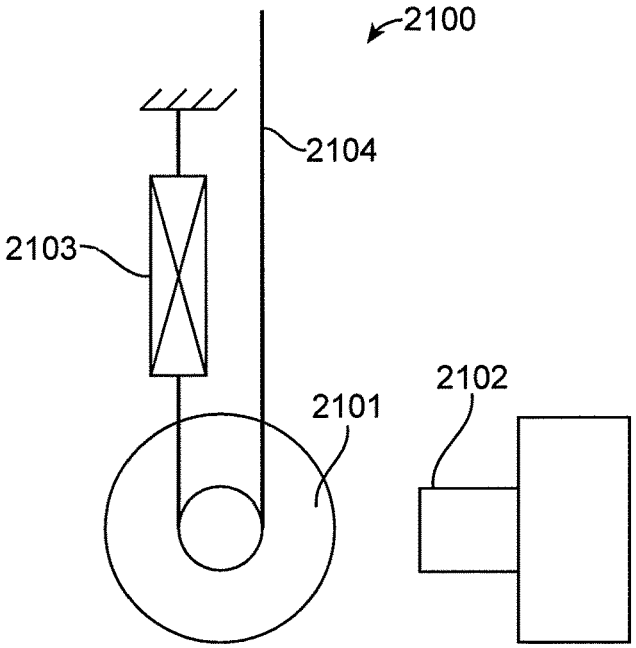
FIG. 21 is a schematic of a rotary based dynamic unweighting device.
Figure 22:
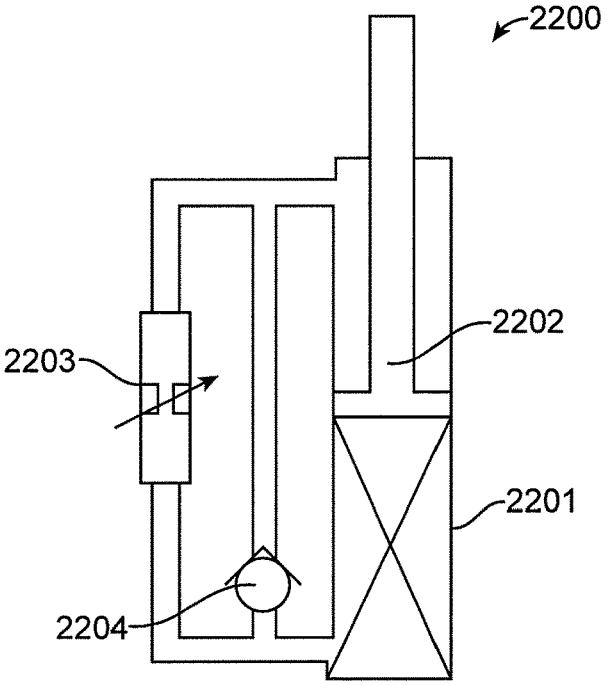
FIG. 22 is a schematic view of a linear based dynamic unweighting device.

Unaided running comfort is due not only to the amount of body weight that is carried by the runner's joints, but also by the amount of impact that the runner experiences with each foot strike. While steady-state unweighting systems lessen joint impact to some extent, existing systems are independent of velocity or acceleration, which are key contributors to impact. Thus, referring to FIGS. 21 and 22, in some embodiments, systems described herein can be designed to provide velocity dependent dynamic unweighting that can be used independently or in conjunction with static, steady-state unweighting systems to further improve the running experience. Dynamic resistance can be controlled mechanically or electronically to tune magnitude, phase, and stiffness. FIG. 21 is a schematic of a rotary based dynamic unweighting device 2100 that can be used in place of, or in addition to, any of the unweighting mechanisms described herein. The system of claim 21 can include a pulley 2101 and a cable 2104 (configured to be attached to an unweighting system as described in embodiments above). A spring 2103 with variable spring resistance can be placed within the cable 2104. Further, a one-way clutch 2101 can be used to provide variable dampening and/or inertia. FIG. 22 is a schematic view of a linear based dynamic unweighting device 2200. The device 2200 includes a pneumatic cylinder 2202, a gas or mechanical unweighting spring 2201, a check valve 2204, and a variable flow resistor 2203. Vertical cable or rod motion can activate the device 2200 to provide variable resistance or inertia. In one aspect, either the rotary or linear devices 2100, 2200 can be used in an unweighting system to provide for asymmetric treatment of unweighting of the user to accommodate for various gait mechanics. One particular example is to employ the system of FIG. 21 or 22 in order to dampen the landing or foot strike of a user. Rather than a constant unweighting response, the systems illustrated in FIGS. 21 and 22 are configured to provide the inertia needed to compensate for impact velocity and acceleration or other gait or biomechanical loading that would benefit from such loading.

Figure 23A:
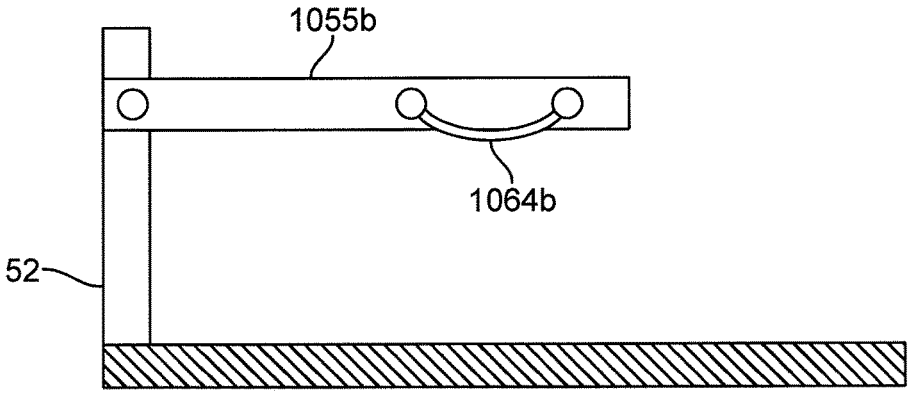
FIGS. 23A, 23B and 23C illustrate an exemplary hip connection device.
Figure 23B:
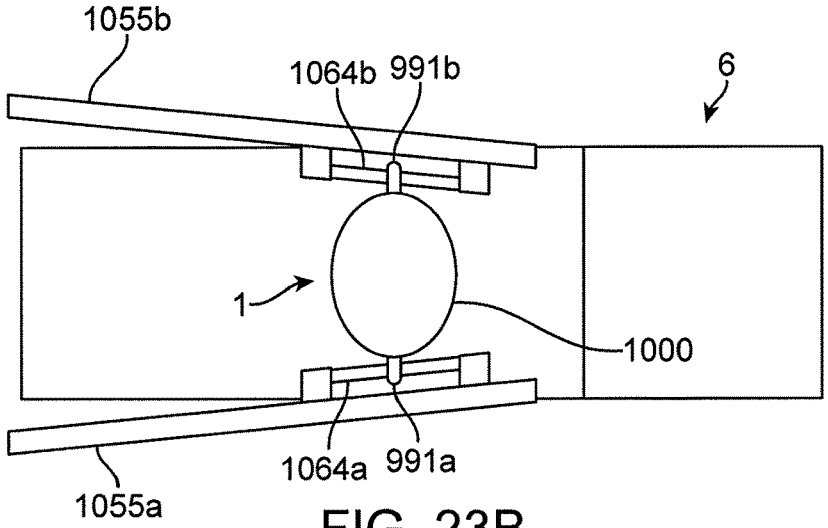
Figure 23C:
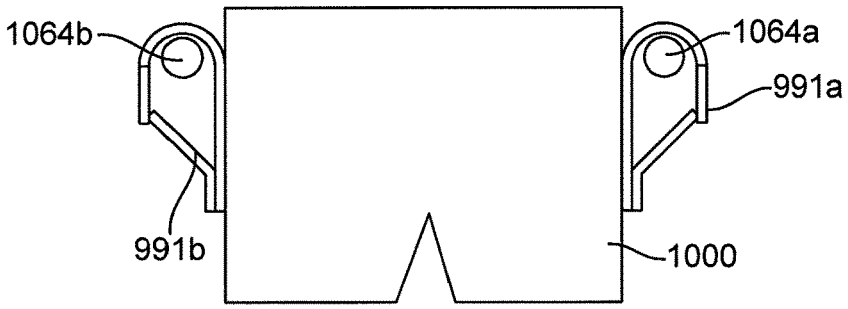

The attachment mechanisms described herein can be any suitable attachment mechanism, such as grooves, slots, or hooks. Further, in some embodiments, the attachment mechanisms can be configured to attach to garments worn by the user. The various types of user garments or shorts as well as the various attachment points, even if not illustrated having exemplary user attachment points or other connectors, may be modified to attach to a user in cooperation with any of the garments or fixation techniques or devices described in co-pending "UNWEIGHTING GARMENTS", incorporated herein by reference in its entirety. FIGS. 23A, 23B and 23C illustrate a hip attachment mechanism for use with an unweighting system (which can be any system described herein) having cantilevered arms 1055*a,b*. The cantilevered arms 1055*a,b* can each include an attachment mechanism 1064*a,b*, which can be a sliding surface or rail. Further, shorts 1000 can include mating attachment features 991*a,b* configured to slide along the surface or rail. This attachment mechanism advantageously allows the users' hips to move backwards and forwards during running to achieve natural gait.

Any of the above embodiments may be provided as needed with a load cell, motor encoder, memory recorder, display, indicator or suitable software or hardware programming to provide repeatability of system operation from user to user or session to session.

Any of the embodiments described herein can use cantilevers, springs, or other resilient member having a spring rate that allows the curved resilient member to track movement of the user's hips vertically while the user is exercising on the exercise device.

Cantilevered arms may be fixed or adjustable height as in the above-described embodiments. It is to be appreciated that the fixed height embodiments such as those illustrated and described with FIG. 2, FIG. 3, FIG. 5, FIG. 6, FIG. 7, and FIG. 8 may be made adjustable height systems by modifying those above-described systems to include the height adjustment devices as illustrated and described with regard to FIG. 1, FIG. 4, FIG. 9, FIG. 10 or FIG. 15. In addition or alternatively, the unweighting systems described herein may use a cantilevered lift mechanism in order to adjust the height of one or more components of the system. One exemplary cantilever lift system is further described in United States Patent Application Publication No. US2011/0120567, entitled "Differential Air Pressure Systems," incorporated herein by reference.

The unweighting systems described herein are envisioned to have a form factor permitting use with, but not limited exclusively to use with, a treadmill that can provide and unweighting capability for users. The amount of unweighting can be user selectable. In some embodiments, the systems described herein can provide effective body weight reductions of up to 80 lbs., in increments of virtually any amount from 1 lb. 5 lbs., 10 lbs., 20 lbs., or more as desired by the user. In some aspects, the form factor and design considerations are intended for use consistent with that of a commercial gym or exercise studio. In addition, the systems described herein include a form factor permitting use directly with known brands of treadmills, such as Precor, Life Fitness and Star Trac. Other treadmill form factors may also be accommodated. The unweighting systems described herein may also be used with other exercise equipment such as stationary bikes, elliptical systems, stair climbers or other equipment. In addition, the form factors of these other similar exercise equipment form factors can be accommodated as well.

The unweighting systems described herein advantageously address the need for a cost-effective system that can be used for exercise alone or, additionally or alternatively, in conjunction with a separate exercise device where the unweighting system can be purchased separately and optionally attached to the separate exercise device in a user's home or gym.

Further, the unweighting systems described herein can be configured to extend substantially behind the user or substantially in front of the user as the user exercises on the exercise device. In general, the front of the treadmill is indicated on the drawings herein by the presence of an upright controller and/or a control or motor box near the treadmill belt. In some embodiments, the position of the unweighting system behind or in front of the user can be chosen to provide ease of access to the exercise device.

Advantageously, the embodiments described herein with two cantilevered arms can provide separate unloading of each side of a user. As such, lateral stability is increased. Further, in some embodiments, a connection element between the two arms can increase the amount of lateral stability provided. Moreover, in some embodiments, the amount of unloading experienced by the user on one side can be different than the amount of unloading experienced by the user on the opposite side to adjust for gait and/or other medical conditions.

As for additional details pertinent to the present invention, materials and manufacturing techniques may be employed as within the level of those with skill in the relevant art. The same may hold true with respect to method-based aspects of the invention in terms of additional acts commonly or logically employed. Also, it is contemplated that any optional feature of the inventive variations described may be set forth and claimed independently, or in combination with any one or more of the features described herein. Likewise, reference to a singular item, includes the possibility that there are plural of the same items present. More specifically, as used herein and in the appended claims, the singular forms "a," "and," "said," and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation. Unless defined otherwise herein, all technical and scientific terms used herein have the same meaning as commonly understood by one of ordinary skill in the art to which this invention belongs. The breadth of the present invention is not to be limited by the subject specification, but rather only by the plain meaning of the claim terms employed.

What is claimed is:

1. An unweighting system for use with an exercise device, comprising:

a frame including a cross member, a right leg, a left leg, a right upright bar and a left upright bar, wherein a spacing between the right leg and the left leg along the cross member is at least as wide as the exercise device whereby the right leg, the left leg and the cross member encircle a portion of the exercise device wherein the frame is configured such that a user gains access to the exercise device by stepping over the cross member and passing completely between the left upright bar and the right upright bar;

a left cantilevered arm assembly extending from the left upright bar, a right cantilevered arm assembly extending from the right upright bar, each cantilevered arm assembly including a cantilever arm having a proximal end attached to one of the upright bars and a distal end configured to receive and couple to the user;

a left resilient member extending between the left upright bar and the left cantilever arm and a right resilient member extending between the right upright bar and the right cantilever arm wherein the left resilient member and the right resilient member are configured to cooperate to unload a portion of the user's weight as the user exercises on the exercise device while coupled between the distal end of the left cantilever arm and the distal end of the right cantilever arm;

a right height adjustment mechanism having a first end coupled to the right upright bar and a second end coupled to the right cantilever arm proximal to the distal end of the right cantilever arm, the right height adjustment mechanism being configured to receive and couple to the user wherein operation of the right height adjustment mechanism changes a vertical spacing between the exercise device and the distal end of the right cantilever arm;

a left height adjustment mechanism having a first end coupled to the left upright bar and a second end coupled to the left cantilever arm proximal to the distal end of the left cantilever arm, the left height adjustment mechanism being configured to receive and couple to the user wherein operation of the left height adjustment mechanism changes a vertical spacing between the exercise device and the distal end of the left cantilever arm.

2. The unweighting system of claim 1, wherein the left cantilevered arm assembly is attached to the left upright bar at a left fulcrum, the left fulcrum configured to pivot to provide height adjustment of the distal end of the left cantilever arm relative to the exercise device and the right cantilevered arm assembly is attached to the right upright bar at a right fulcrum, the right fulcrum configured to pivot to provide height adjustment of the distal end of the right cantilever arm relative to the exercise device.

3. The unweighting system of claim 2 wherein the left fulcrum and the right fulcrum are configured to be positioned below a shoulder of the user when the user of the exercise device is unweighted by the unweighting system.

4. The unweighting system of claim 1, wherein the first end of the left height adjustment mechanism is configured to slide vertically relative to the left upright bar to provide height adjustment of the left cantilevered arm assembly, and the first end of the right height adjustment mechanism is configured to slide vertically relative to the right upright bar to provide height adjustment of the right cantilevered arm assembly.

5. The unweighting system of claim 1, wherein at least one of the left resilient member and the right resilient member is variable to adjust a degree of unloading experienced by the user.

6. The unweighting system of claim 1, wherein in use, the left cantilevered arm assembly and the right cantilevered arm assembly are configured to be positioned below the user's torso and to receive and couple to the user below the user's torso to unweight the user of the exercise device.

7. The unweighting system of claim 6, wherein in use to unweight the user of the exercise device the left cantilevered arm assembly and the right cantilevered arm assembly are configured to receive and couple proximate to the user's hips with the left cantilever arm coupled to a user's left side and the right cantilever arm coupled to a user's right side.

8. The unweighting system of claim 1, wherein the exercise device is a treadmill.

9. The unweighting system of claim 1, wherein a distance between a distal most end of the left cantilever arm and the right cantilever arm is adjustable to fit the user.

10. The unweighting system of claim 1, wherein the left cantilevered arm assembly is pivotably attached to the left upright bar and the right cantilevered arm assembly is pivotably attached to the right upright bar.

11. A method of unweighting a user while using an exercise machine, comprising:

passing the user between a left upright bar and a right upright bar of an unweighting system into an unweighting position proximal to a distal most end of each of a left cantilever arm coupled to the left upright bar and a right cantilever arm coupled to the right upright bar;

operating a left height adjustment assembly to move a proximal end of the left cantilever arm along the left upright bar to position a user attachment mechanism of the left cantilever arm adjacent to a left side of the user's hips;

operating a right height adjustment assembly to move a proximal end of the right cantilever arm along the right upright bar to position a user attachment mechanism of the right cantilever arm adjacent to a right side of the user's hips;

coupling a right side of the user to the user attachment mechanism of the right cantilever arm and coupling a left side of the user to the user attachment mechanism of the left cantilever arm; and operating each of a left unweighting subassembly for compressing a resilient member coupled to the left cantilever arm, and a right unweighting subassembly for compressing a resilient member coupled to the right cantilever arm, to unweight at least a portion of the weight of the user.

12. The method of claim 11, further comprising adjusting a relative position of the user attachment mechanism of the left cantilever arm with respect to the user attachment mechanism of the right cantilever arm by adjusting a width adjustment assembly coupled between the left cantilevered arm and the right cantilevered arm.

* * * * *